US008159424B2

(12) United States Patent
Yamamoto et al.

(10) Patent No.: US 8,159,424 B2
(45) Date of Patent: Apr. 17, 2012

(54) DISPLAY DEVICE AND ELECTRONIC APPARATUS

(75) Inventors: Tetsuro Yamamoto, Kanagawa (JP); Junichi Yamashita, Tokyo (JP); Katsuhide Uchino, Kanagawa (JP); Seiichiro Jinta, Aichi (JP)

(73) Assignee: Sony Corporation, Tokyo (JP)

( * ) Notice: Subject to any disclaimer, the term of this patent is extended or adjusted under 35 U.S.C. 154(b) by 343 days.

(21) Appl. No.: 12/458,810

(22) Filed: Jul. 23, 2009

(65) Prior Publication Data

US 2010/0026612 A1 Feb. 4, 2010

(30) Foreign Application Priority Data

Aug. 4, 2008 (JP) ..... 2008-200838

(51) Int. Cl.
*G09G 3/30* (2006.01)

(52) U.S. Cl. ..... 345/76; 345/212; 345/214

(58) Field of Classification Search ..... 345/76–83, 345/90–100, 204–215; 315/169.1–169.4
See application file for complete search history.

(56) References Cited

U.S. PATENT DOCUMENTS 6,356,026 B1 * 3/2002 Murto ..... 315/111.81
6,693,388 B2 * 2/2004 Oomura ..... 315/169.3

FOREIGN PATENT DOCUMENTS

JP 10-319907 A 12/1998
JP 2003-140567 A 5/2003
JP 2005-202255 A 7/2005
JP 2007-310311 11/2007
JP 2008-051990 A 3/2008
JP 2008-065199 A 3/2008
JP 2008-065200 A 3/2008
JP 2008-134509 A 6/2008

OTHER PUBLICATIONS

Japanese Office Action issued Aug. 17, 2010 for corresponding Japanese Application No. 2008-200838.
Japanese Office Action issued May 18, 2010 for corresponding Japanese Application No. 2008-200838.

* cited by examiner

*Primary Examiner* — Vijay Shankar
(74) *Attorney, Agent, or Firm* — Rader, Fishman & Grauer PLLC

(57) ABSTRACT

Disclosed herein is a sampling transistor in an embodiment of the present invention is kept at the on-state with a time width shorter than one horizontal cycle, during the period from the rising of a control pulse supplied from a scanner to a scan line WS to the falling of the control pulse, and samples a video signal from a signal line SL to write the video signal to a hold capacitor. The sampling transistor includes the channel region between the source and the drain and has a sandwich gate structure in which a shield that electrically shields the channel region is disposed on the other side of the channel region. This suppresses change in the threshold voltage of the sampling transistor.

6 Claims, 18 Drawing Sheets

(1)

(2), (3)

(4)

(5)

(6)

(7)

DISPLAY DEVICE AND ELECTRONIC APPARATUS

BACKGROUND OF THE INVENTION

1. Field of the Invention

The present invention relates to an active-matrix display device including light-emitting elements in its pixels. More specifically, the invention relates to a technique for improving the reliability of thin film transistors formed in the pixels.

2. Description of the Related Art

In recent years, development of flat self-luminous display devices including organic EL devices as light-emitting elements is being actively promoted. The organic EL device is based on a phenomenon that an organic thin film emits light in response to application of an electric field thereto. The organic EL device can be driven by application voltage of 10 V or lower, and thus has low power consumption. Furthermore, because the organic EL device is a self-luminous element that emits light by itself, it does not need an illuminating unit and thus easily allows reduction in the weight and thickness of the display device. Moreover, the response speed of the organic EL device is as very high as about several microseconds, which causes no image lag in displaying of moving images.

Among the flat self-luminous display devices including the organic EL devices in the pixels, particularly an active-matrix display device in which thin film transistors are integrally formed as drive elements in the respective pixels is being actively developed. The active-matrix flat self-luminous display device is disclosed in e.g. Japanese Patent Laid-open No. 2007-310311.

FIG. 23 is a schematic circuit diagram showing one example of the active-matrix display device of a related art. The display device includes a pixel array part 1 and a peripheral drive part. The drive part includes a horizontal selector 3 and a write scanner 4. The pixel array part 1 includes signal lines SL disposed along the columns and scan lines WS disposed along the rows. Pixels 2 are disposed at the intersections of the signal lines SL and the scan lines WS. FIG. 23 shows only one pixel 2 for easy understanding. The write scanner 4 includes shift registers. The shift registers operate in response to a clock signal ck supplied from the external and sequentially transfer a start pulse sp supplied from the external similarly, to thereby sequentially output a control signal to the scan lines WS. The horizontal selector 3 supplies a video signal to the signal lines SL in matching with the line-sequential scanning by the write scanner 4.

The pixel 2 includes a sampling transistor T1, a drive transistor T2, a hold capacitor C1, and a light-emitting element EL. The drive transistor T2 is a P-channel transistor. The source thereof is connected to a power supply line and the drain thereof is connected to the light-emitting element EL. The gate of the drive transistor T2 is connected to the signal line SL via the sampling transistor T1. The sampling transistor T1 is turned on in response to the control signal supplied from the write scanner 4 to thereby sample the video signal supplied from the signal line SL and write it to the hold capacitor C1. The drive transistor T2 receives, at its gate, the video signal written to the hold capacitor C1 as a gate voltage Vgs, and causes a drain current Ids to flow to the light-emitting element EL. This causes the light-emitting element EL to emit light with the luminance dependent on the video signal. The gate voltage Vgs refers to the potential of the gate relative to that of the source.

The drive transistor T2 operates in the saturation region, and the relationship between the gate voltage Vgs and the drain current Ids is represented by the following characteristic equation.

$$Ids=(1/2)\mu(W/L)Cox(Vgs-Vth)^2$$

In this equation, μ denotes the mobility of the drive transistor, W denotes the channel width of the drive transistor, L denotes the channel length of the drive transistor, Cox denotes the capacitance of the gate insulating film of the drive transistor per unit area, and Vth denotes the threshold voltage of the drive transistor. As is apparent from this characteristic equation, when operating in the saturation region, the drive transistor T2 functions as a constant current source that supplies the drain current Ids depending on the gate voltage Vgs.

FIG. 24 is a graph showing the voltage-current characteristic of the light-emitting element EL. In this graph, an anode voltage V is plotted on the abscissa and the drive current Ids is plotted on the ordinate. The anode voltage of the light-emitting element EL is equivalent to the drain voltage of the drive transistor T2. The light-emitting element EL has a tendency that its current-voltage characteristic changes over time and the characteristic curve gradually falls down with time elapse. Therefore, the anode voltage (drain voltage) V changes even if the drive current Ids is constant. However, in the pixel circuit 2 shown in FIG. 23, the drive transistor T2 operates in the saturation region and allows the flowing of the drive current Ids dependent on the gate voltage Vgs irrespective of change in the drain voltage. This makes it possible to keep the light-emission luminance constant irrespective of aging change in the characteristic of the light-emitting element EL.

FIG. 25 is a circuit diagram showing another example of a related-art pixel circuit. This pixel circuit is different from the pixel circuit shown in FIG. 23 in that the drive transistor T2 is not a P-channel transistor but an N-channel transistor. In many cases, it is more advantageous that all of the transistors included in the pixel are N-channel transistors in terms of the circuit manufacturing process.

SUMMARY OF THE INVENTION

The sampling transistor T1 is kept at the on-state during the period from the rising of the control pulse supplied from the write scanner 4 to the scan line WS to the falling of the control pulse with a time width shorter than one horizontal cycle (1 H), and samples the video signal from the signal line SL to write it to the hold capacitor C1. In step with enhancement in the definition of the pixel array part 1, the number of scan lines WS increases. Along with this, one horizontal period (1 H) becomes shorter, and correspondingly the width of the time of the sampling of the video signal by the sampling transistor T1 (hereinafter, this time width will be often referred to as the signal writing time, in the present specification) is also significantly shortened.

On the other hand, a thin film transistor (TFT) including a polycrystalline silicon film or the like in its element region is frequently used as the sampling transistor T1. The thin film transistor has a tendency that its threshold voltage changes with time elapse, and the operating point of the sampling transistor changes in linkage with the threshold voltage change. Specifically, the width of the time during which the sampling transistor is in the on-state (signal writing time) changes, and therefore the level of the video signal written to the hold capacitor C1 also changes. Along with this, the luminance of the light-emitting element is lowered problematically. Furthermore, if the change in the threshold voltage of the sampling transistor T1 differs from pixel to pixel, there is a problem that variation arises in the luminance and accordingly the uniformity of the screen is spoiled.

There is a need for the present invention to provide a display device that can suppress change in the threshold voltage of a sampling transistor. To meet this need, the following configuration is devised. Specifically, according to a mode of the present invention, there is provided a display device including a pixel array part and a drive part that drives the pixel array part. The pixel array part includes scan lines disposed along rows, signal lines disposed along columns, and pixels that are disposed at the intersections of the scan lines and the signal lines and are arranged in a matrix. The drive part includes a control scanner that sequentially applies a control pulse to the scan lines with a horizontal cycle to thereby line-sequentially scan the pixels on a row-by-row basis and a signal selector that supplies a video signal to the signal lines disposed along the columns in matching with the line-sequential scanning. The pixel includes a sampling transistor having a gate connected to the scan line and a source and a drain one of which is connected to the signal line, a drive transistor having a gate connected to the other of the source and the drain of the sampling transistor and a source and a drain one of which is connected to a power supply, a light-emitting element connected to the other of the source and the drain of the drive transistor, and a hold capacitor connected between the source and the gate of the drive transistor. The sampling transistor is kept at the on-state during the period from the rising of a control pulse supplied from the control scanner to the scan line to the falling of the control pulse with a time width shorter than one horizontal cycle, and samples a video signal from the signal line to write the video signal to the hold capacitor. The drive transistor causes a drive current dependent on the video signal written to the hold capacitor to flow to the light-emitting element for light emission. The sampling transistor includes a channel region between the source and the drain and has a sandwich gate structure in which the gate exists on one surface side of the channel region with the intermediary of an insulating film and a shield that electrically shields the channel region is disposed on the other surface side of the channel region.

According to the mode of the present invention, the sampling transistor includes the channel region between the source and the drain and has the sandwich gate structure in which the gate exists on one surface side of the channel region with the intermediary of the insulating film and the shield that electrically shields the channel region is disposed on the other surface side of the channel region. The shield is connected to the same potential as that of the gate. By employing the sandwich gate structure for the sampling transistor in this manner, change in the threshold voltage of the sampling transistor can be suppressed, and reduction in the light-emission luminance over time and the occurrence of image quality defects such as streaks and unevenness can be suppressed. Furthermore, by employing the sandwich gate structure for the sampling transistor, the mobility of the sampling transistor can be enhanced, and the on-voltage thereof can be lowered. Thus, reduction in the power consumption can be realized. In particular, if the sampling transistor carries out on/off-operation at high speed with a time width shorter than one horizontal period, the prevention of the change in the threshold voltage stabilizes the operating point and provides a large effect of image quality enhancement.

DETAILED DESCRIPTION OF THE PREFERRED EMBODIMENT

Figure 1:
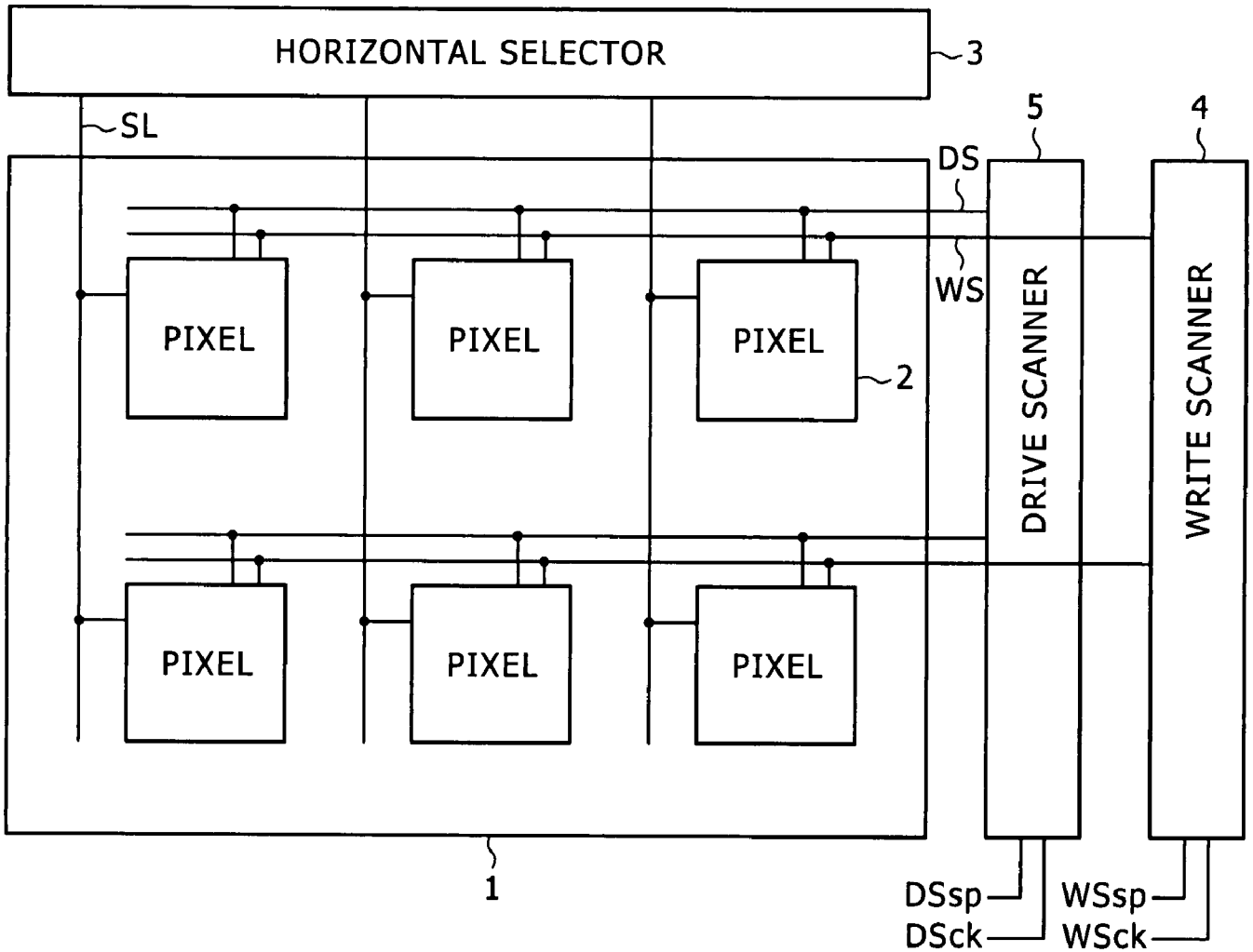
FIG. 1 is a block diagram showing the entire configuration of a display device according to an embodiment of the present invention.

An embodiment of the present invention will be described in detail below with reference to the drawings. FIG. 1 is a block diagram showing the entire configuration of a display device according to the embodiment of the present invention. As shown in FIG. 1, this display device includes a pixel array part 1 and a drive part (3, 4, 5) for driving the pixel array part 1. The pixel array part 1 includes scan lines WS along the rows, signal lines SL along the columns, pixels 2 that are disposed at the intersections of both the lines and thus arranged in a matrix, and power feed lines DS disposed corresponding to the respective rows of the pixels 2. The drive part (3, 4, 5) includes a control scanner (write scanner) 4, a power supply scanner (drive scanner) 5, and a signal selector (horizontal selector) 3. The write scanner 4 sequentially supplies a control signal pulse to the respective scan lines WS to thereby line-sequentially scan the pixels 2 on a row-by-row basis. The drive scanner 5 provides a supply voltage that is switched between a first potential and a second potential to the respective power feed lines DS in matching with this line-sequential scanning. The horizontal selector 3 supplies a signal potential and a reference potential as a video signal to the signal lines SL along the columns in matching with this line-sequential scanning. The write scanner 4 operates in response to a clock signal WSck supplied from the external and sequentially transfers a start pulse WSsp supplied from the external similarly, to thereby output the control signal pulse to the respective scan lines WS. The drive scanner 5 operates in response to a clock signal DSck supplied from the external and sequentially transfers a start pulse DSsp supplied from the external similarly, to thereby line-sequentially switch the potentials of the power feed lines DS.

Figure 2:
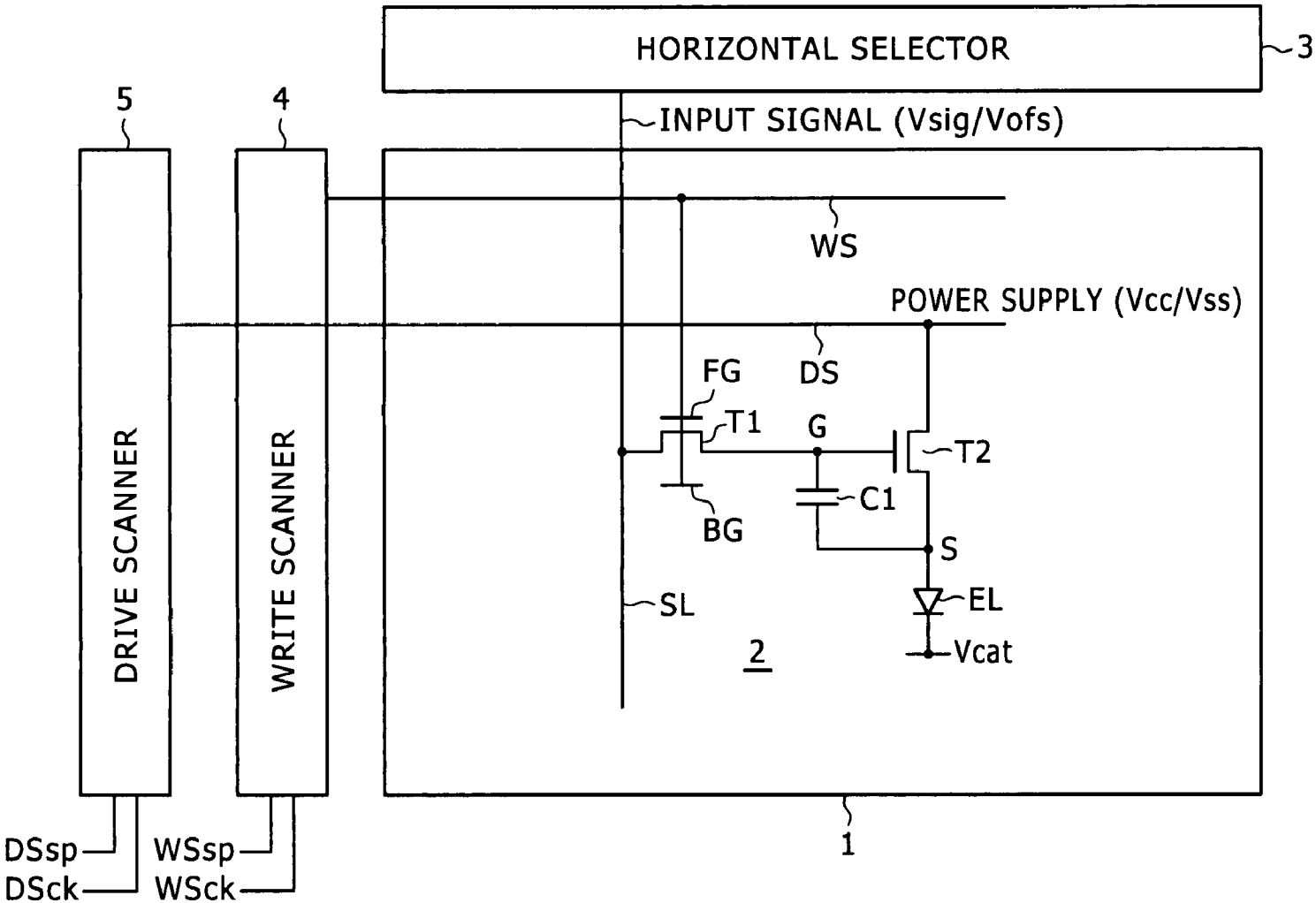
FIG. 2 is a circuit diagram showing one example of a pixel formed in the display device shown in FIG. 1.

FIG. 2 is a circuit diagram showing the specific configuration of the pixel 2 included in the display device shown in FIG. 1. As shown in the diagram, the signal selector (horizontal selector) 3 supplies a signal potential Vsig and a reference potential Vofs as the video signal to the signal lines SL along the columns in matching with the line-sequential scanning. This line-sequential scanning is carried out by sequentially applying the pulse-manner control signal to the respective scan lines WS with the horizontal cycle. The signal selector 3 carries out switching between the signal potential Vsig and the reference potential Vofs in one horizontal cycle (1H) in matching with this line-sequential scanning.

In this configuration, the sampling transistor T1 is kept at the on-state during the period from the rising of the control pulse supplied from the control scanner (write scanner) 4 to the scan line WS to the falling of the control pulse in the time zone during which the video signal supplied to the signal line SL is at the signal potential Vsig, and samples the signal potential Vsig from the signal line SL to write it to the hold capacitor C1. In addition, the sampling transistor T1 carries out negative feedback of the drive current flowing through the drive transistor T2 at this time to the hold capacitor C1, to thereby give correction relating to the mobility μ of the drive transistor T2 to the signal potential written to the hold capacitor C1.

The pixel circuit shown in FIG. 2 has a threshold voltage correction function in addition to the above-described mobility correction function. Specifically, the power supply scanner (drive scanner) 5 switches the potential of the power feed line DS from a first potential Vcc to a second potential Vss at a first timing before the sampling of the signal potential Vsig by the sampling transistor T1. The control scanner (write scanner) 4 turns on the sampling transistor T1 at a second timing before the sampling of the signal potential Vsig by the sampling transistor T1 similarly, to thereby apply the reference potential Vofs from the signal line SL to the gate G of the drive transistor T2 and set the potential of the source S of the drive transistor T2 to the second potential Vss from the potential at the time of the light emission. The power supply scanner (drive scanner) 5 switches the potential of the power feed line DS from the second potential Vss to the first potential Vcc at a third timing after the second timing, to thereby hold the voltage equivalent to the threshold voltage Vth of the drive transistor T2 in the hold capacitor C1. This threshold voltage correction function allows this display device to cancel the influence of variation in the threshold voltage Vth of the drive transistor T2 from pixel to pixel. Either the first timing or the second timing may be earlier than the other.

The pixel circuit 2 shown in FIG. 2 is also provided with a bootstrap function. Specifically, at the timing when the signal potential Vsig has been held in the hold capacitor C1, the write scanner 4 turns off the sampling transistor T1 to thereby electrically isolate the gate G of the drive transistor T2 from the signal line SL. This allows the gate potential of the drive transistor T2 to be linked to change in the source potential of the drive transistor T2 and thus allows the voltage Vgs between the gate G and the source S to be kept constant. Therefore, even when the current-voltage characteristic of the light-emitting element EL changes over time, the gate voltage Vgs can be kept constant and thus no change occurs in the luminance.

A characteristic of the embodiment of the present invention is that the sampling transistor T1 includes a channel region between the source and the drain and has a sandwich gate structure in which a gate FG exists on one surface side of the channel region with the intermediary of an insulating film and a shield BG that electrically shields the channel region is disposed on the other surface side of the channel region. Compared with the case in which the sandwich gate structure is not employed, change in the threshold voltage of the sampling transistor T1 can be suppressed, and thereby change in the width of the time during which the sampling transistor T1 is in the on-state (i.e. the signal writing period) is suppressed. The shield BG is connected to the same potential as that of the gate FG. Therefore, the shield BG functions as a back gate. In contrast, the drive transistor T2 does not have the sandwich gate structure unlike the sampling transistor T1 but has a shield structure different from the sandwich gate structure.

Figure 3:
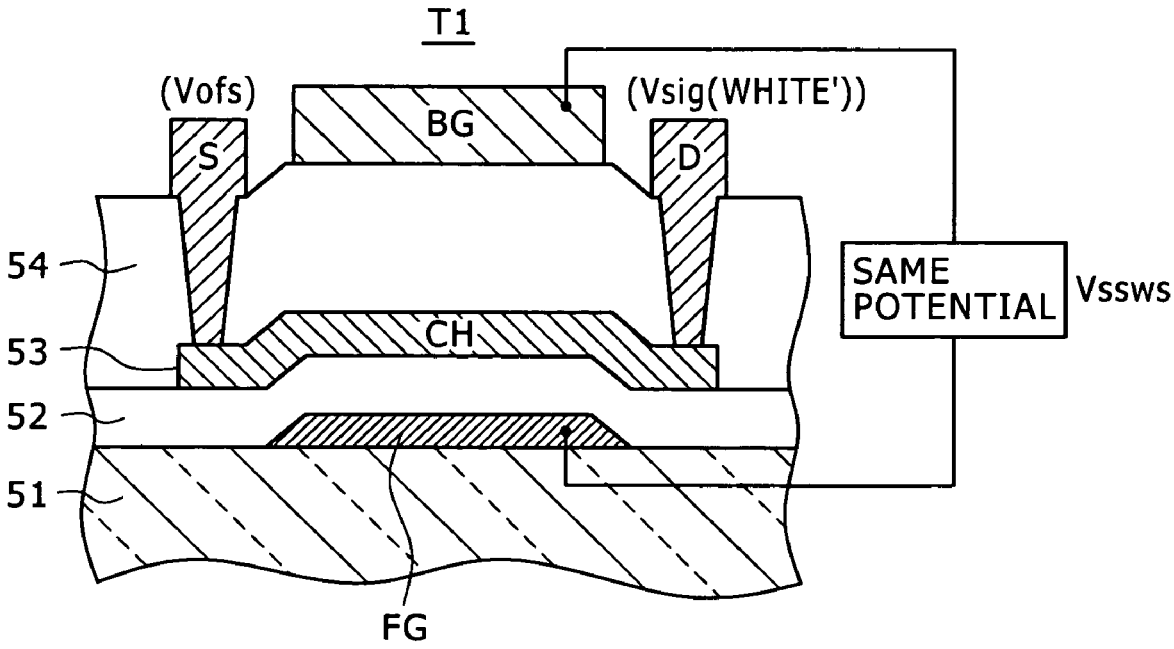
FIG. 3 is a sectional view showing the structure of a sampling transistor formed in the pixel shown in FIG. 2.

FIG. 3 is a schematic diagram showing the sectional structure of the sampling transistor T1 having the sandwich gate structure. As shown in the diagram, the gate electrode FG composed of metal Mo or the like is formed on a substrate 51 composed of glass or the like. Over the gate electrode FG, a semiconductor thin film 53 is formed in an island manner with the intermediary of a gate insulating film 52. This semiconductor thin film 53 is composed of e.g. polycrystalline silicon (Poly-Si) and divides into a pair of current terminals and a channel region CH therebetween. One of the pair of current terminals serves as a source S and the other serves as a drain D. The channel region CH is located just above the gate electrode FG. The channel region CH is covered by an interlayer insulating film 54. Contact holes are opened in the interlayer insulating film 54, and electrodes connected to the source S and the drain D of the sampling transistor T1 are formed therein. In the diagram, the electrode of the source S is connected to the signal line SL, and Vofs and Vsig are alternately applied thereto in 1 H. Only Vofs is shown in the diagram. On the other hand, the drain D is connected to the gate G of the drive transistor T2. This diagram shows the state at the time of white light emission, and shows the state in which a signal voltage Vsig(white)' for the white level is written to the gate of the drive transistor T2. The metal shield BG is formed on the interlayer insulating film 54 and electrically shields the channel region CH. This shield BG is connected to the same potential as that of the gate electrode FG. The control pulse signal is applied from the scan line WS to the gate electrode FG. The low level of the control signal is represented as Vssws.

As shown in FIG. 3, at the time of white light emission, the potential of the gate of the sampling transistor T1 is Vssws, the potential of the source (signal line) is Vofs and Vsig (only Vofs is shown in the diagram), and the potential of the drain (the gate of the drive transistor T2) is Vsig(white)'. In the embodiment of the present invention, the Al shield at the same potential as that of the gate electrode exists above the gate electrode, and an electric field is hardly applied to the Poly-Si unlike the related art. Thus, electrons in the Poly-Si are not trapped by the insulating film 54, and therefore the shift of the threshold voltage of the sampling transistor T1 is absent even with time elapse. This eliminates the extension of the mobility correction time due to the Vth shift of the sampling transistor T1. Accordingly, the lowering of the light-emission luminance with time elapse is absent, and the occurrence of streaks and unevenness is also absent.

The embodiment of the present invention can be applied to not only the sampling transistor but also a switching transistor that is turned on/off on the order of microseconds. By providing the sampling transistor with the sandwich gate in accordance with the embodiment of the present embodiment, change in the threshold voltage of the sampling transistor can be suppressed, and the lowering of the light-emission luminance with time elapse and the occurrence of image quality defects such as streaks and unevenness can be suppressed. By providing the sampling transistor with the sandwich gate in accordance with the embodiment of the present embodiment, the mobility of the sampling transistor can be enhanced, and the on-voltage thereof can be lowered.

The reason why the drive transistor T2 does not need to have the sandwich gate structure in the embodiment of the present invention will be described below. A characteristic of a low-temperature poly-silicon TFT is that generally it has high mobility and allows the flowing of large current even with low gate-source voltage. Furthermore, the current necessary for the light-emitting element EL to perform white displaying is small, and therefore it is general to set the signal voltage low and set the L-length of the drive transistor large. However, if the amplitude of the signal voltage (the difference between the voltage for white and the voltage for black) is lower than certain voltage, the voltage equivalent to one grayscale is low, and thus the grayscale voltages may not be normally ensured. In such a state, there is nothing for it but to set the L-length of the drive transistor large.

In general, providing a transistor with the sandwich gate enhances the mobility of the transistor. That is, in terms of achievement of the flowing of the same current, providing a transistor with the sandwich gate can decrease the transistor size and the gate-source voltage. However, the signal amplitude may not be set lower than certain constant voltage as described above. Therefore, if the sandwich gate is employed for the drive transistor, the L-length of the drive transistor needs to be set large. However, if the L-length of the transistor is increased, the area of the transistor is increased, which causes difficulty in enhancement in the definition and the yield.

Furthermore, the drive transistor is in the on-state in the present driving irrespective of the light-emission state and the non-light-emission state, and the threshold correction operation and the mobility correction operation are carried out. Therefore, even if the threshold voltage of the drive transistor is shifted, no problem arises because the correction is carried out. Thus, the drive transistor does not need to have the sandwich gate.

Figure 4:
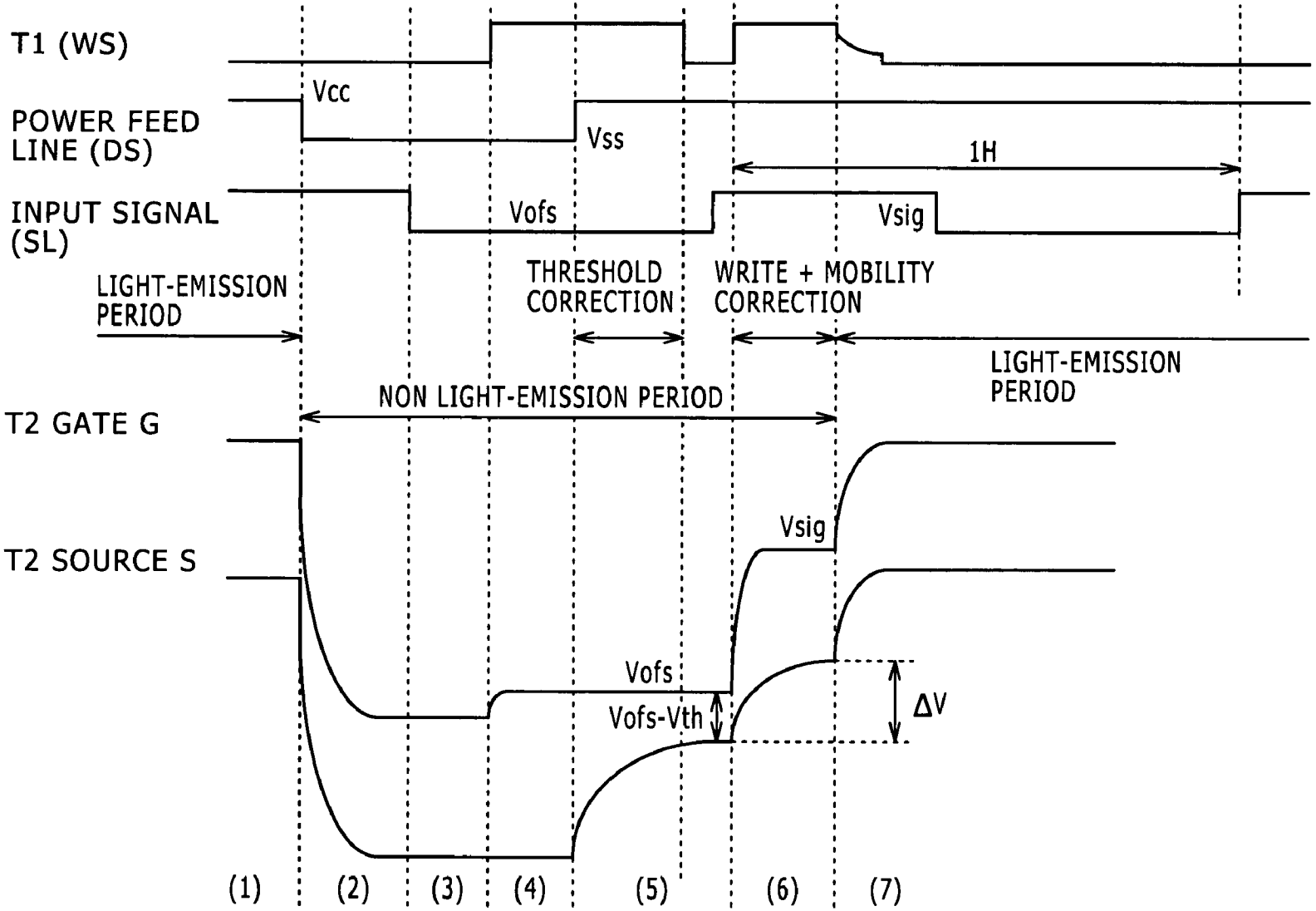
FIG. 4 is a timing chart for explaining the operation of the pixel shown in FIG. 2.

FIG. 4 is a timing chart for explaining the operation of the pixel shown in FIG. 2. This timing chart is one example and the control sequence of the pixel circuit shown in FIG. 2 is not limited to the timing chart of FIG. 4. In this timing chart, potential changes of the scan line WS, the power feed line DS, and the signal line SL are shown along the same time axis. The potential change of the scan line WS corresponds to the control signal and controls the opening/closing of the sampling transistor T1. The potential change of the power feed line DS corresponds to the switching of the supply voltage between Vcc and Vss. The potential change of the signal line SL corresponds to the switching of the input signal between the signal potential Vsig and the reference potential Vofs. Furthermore, in parallel to these potential changes, potential changes of the gate G and the source S of the drive transistor T2 are also shown. The potential difference between the gate G and the source S is equivalent to Vgs as described above.

In this timing chart, the operation period is divided into periods (1) to (7) corresponding to the transition of the pixel operation for convenience. In the period (1) immediately before the start of the description-subject field, the light-emitting element EL is in the light-emission state. Thereafter, a new field of the line-sequential scanning starts. At the start of the first period (2) of the new field, the potential of the power feed line DS is switched from the first potential Vcc to the second potential Vss. At the start of the next period (3), the input signal is switched from Vsig to Vofs. At the start of the next period (4), the sampling transistor T1 is turned on. In the periods (2) to (4), the gate potential and the source potential of the drive transistor T2 are initialized from those at the time of the light emission. The periods (2) to (4) are equivalent to a preparatory period for the threshold voltage correction. In this preparatory period, the gate G of the drive transistor T2 is initialized to Vofs and the source S thereof is initialized to Vss. Subsequently, the threshold voltage correction operation is carried out in the threshold correction period (5), so that the voltage equivalent to the threshold voltage Vth is held between the gate G and the source S of the drive transistor T2. In practice, the voltage equivalent to Vth is written to the hold capacitor C1 connected between the gate G and the source S of the drive transistor T2. Thereafter, the sampling transistor T1 is temporarily turned off, and then the writing period/mobility correction period (6) starts. In this period, the signal potential Vsig of the video signal is written to the hold capacitor C1 in such a manner as to be added to Vth, and the voltage ΔV for the mobility correction is subtracted from the voltage held in the hold capacitor C1. In this writing period/mobility correction period (6), the sampling transistor T1 should be kept at the conductive state in the time zone during which the signal line SL is at the signal potential Vsig. Thereafter, the light-emission period (7) starts, so that the light-emitting element emits light with the luminance dependent on the signal potential Vsig. In this light emission, the light-emission luminance of the light-emitting element EL is not affected by variations in the threshold voltage Vth and the mobility μ of the drive transistor T2 because the signal potential Vsig has been adjusted with the voltage equivalent to the threshold voltage Vth and the voltage ΔV for the mobility correction. At the initial stage of the light-emission period (7), bootstrap operation is carried out and thereby the gate potential and the source potential of the drive transistor T2 rise up with the voltage Vgs between the gate G and the source S of the drive transistor T2 kept constant.

Figure 5:
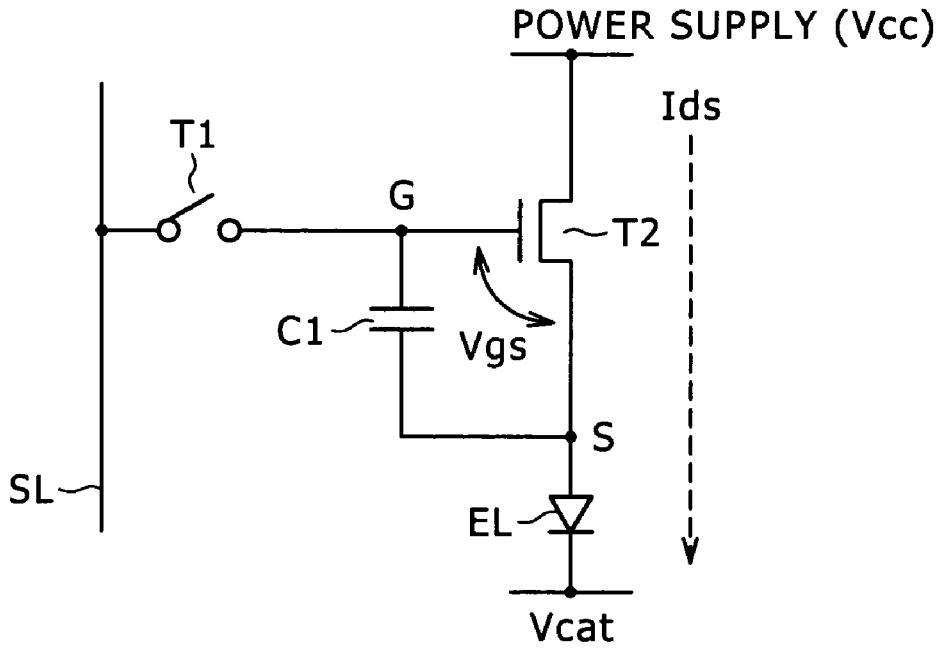
FIG. 5 is a schematic diagram for explaining the operation of the pixel shown in FIG. 2.

With reference to FIGS. 5 to 12, the operation of the pixel circuit shown in FIG. 2 will be described in detail below. Referring initially to FIG. 5, in the light-emission period (1), the supply potential is set to Vcc and the sampling transistor T1 is kept at the off-state. At this time, the drive current Ids flowing to the light-emitting element EL has the value represented by the above-mentioned transistor characteristic equation depending on the voltage Vgs applied between the gate G and the source S of the drive transistor T2 because the drive transistor T2 is so set as to operate in the saturation region.

Figure 6:
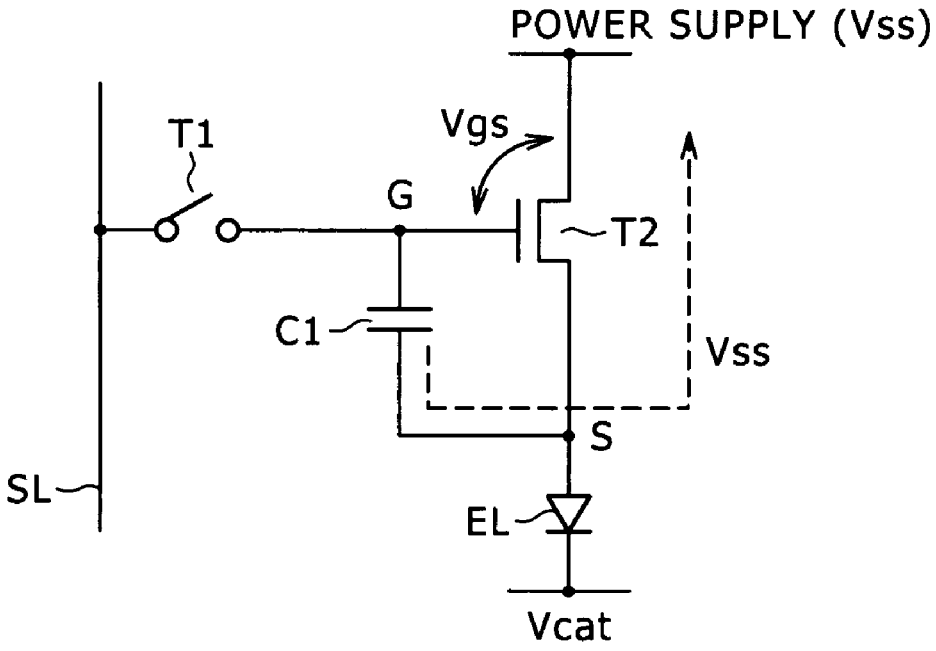
FIG. 6 is a schematic diagram for explaining the operation of the pixel shown in FIG. 2.

Referring next to FIG. 6, at the start of the preparatory period (2), (3), the potential of the power feed line (power supply line) is set to Vss. Vss is so designed as to be lower than the sum of the threshold voltage Vthel and the cathode voltage Vcat of the light-emitting element EL. That is, the relationship Vss<Vthel+Vcat is satisfied. Therefore, the light-emitting element EL stops the light emission and the power supply line side becomes the source of the drive transistor T2. At this time, the anode of the light-emitting element EL is charged to Vss.

Figure 7:
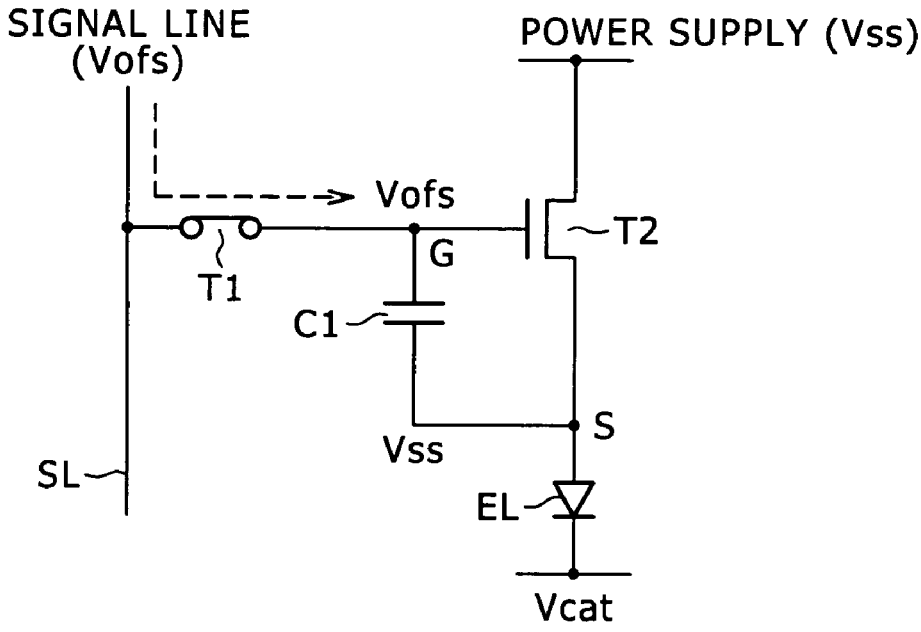
FIG. 7 is a schematic diagram for explaining the operation of the pixel shown in FIG. 2.

Referring next to FIG. 7, in the next preparatory period (4), the potential of the signal line SL is Vofs and the sampling transistor T1 is turned on, so that the gate potential of the drive transistor T2 is set to Vofs. In this way, the potentials of the source S and the gate G of the drive transistor T2 are initialized from those at the time of the light emission, so that the gate-source voltage Vgs becomes Vofs−Vss. This Vgs (=Vofs−Vss) is so designed as to be higher than the threshold voltage Vth of the drive transistor T2. By thus initializing the drive transistor T2 so that the relationship Vgs>Vth may be satisfied, the preparation for the threshold voltage correction operation in the next period is completed.

Figure 8:
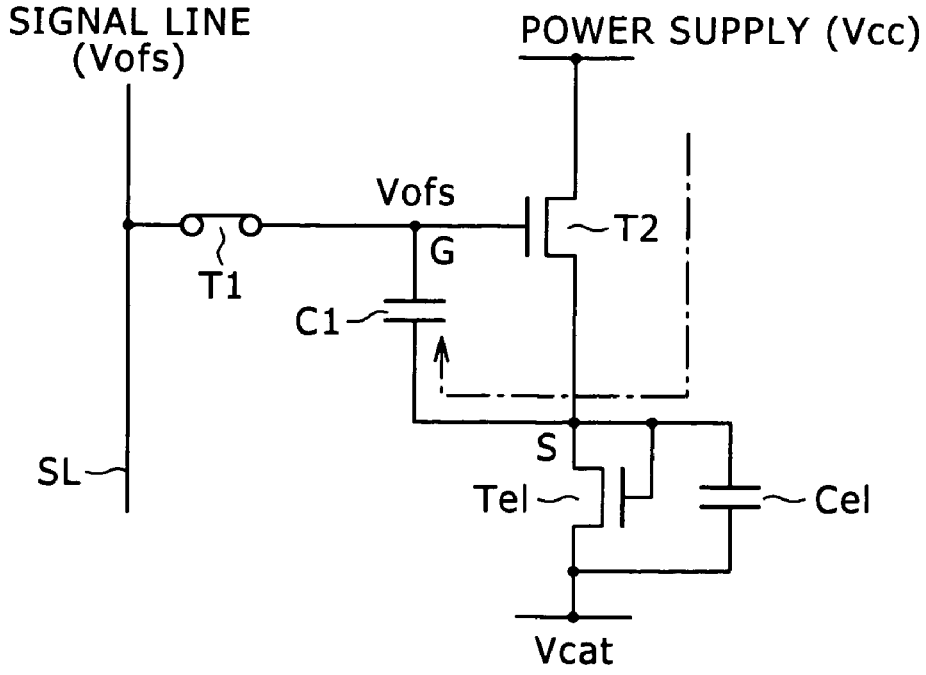
FIG. 8 is a schematic diagram for explaining the operation of the pixel shown in FIG. 2.

Referring next to FIG. 8, at the start of the threshold voltage correction period (5), the potential of the power feed line DS (power supply line) is returned to Vcc. Switching the supply voltage to Vcc causes the anode side of the light-emitting element EL to become the source S of the drive transistor T2, so that a current flows as shown in the diagram. At this time, the equivalent circuit of the light-emitting element EL is represented by parallel connection of a diode Tel and a capacitor Cel as shown in the diagram. Because the anode potential (i.e. the source potential Vss) is lower than Vcat+Vthel, the diode Tel is in the off-state, and therefore the leakage current flowing therethrough is considerably smaller than the current flowing through the drive transistor T2. Therefore, most of the current flowing through the drive transistor T2 is used to charge the hold capacitor C1 and the equivalent capacitor Cel. After the threshold voltage correction, the sampling transistor T1 is temporarily turned off.

Figure 9:
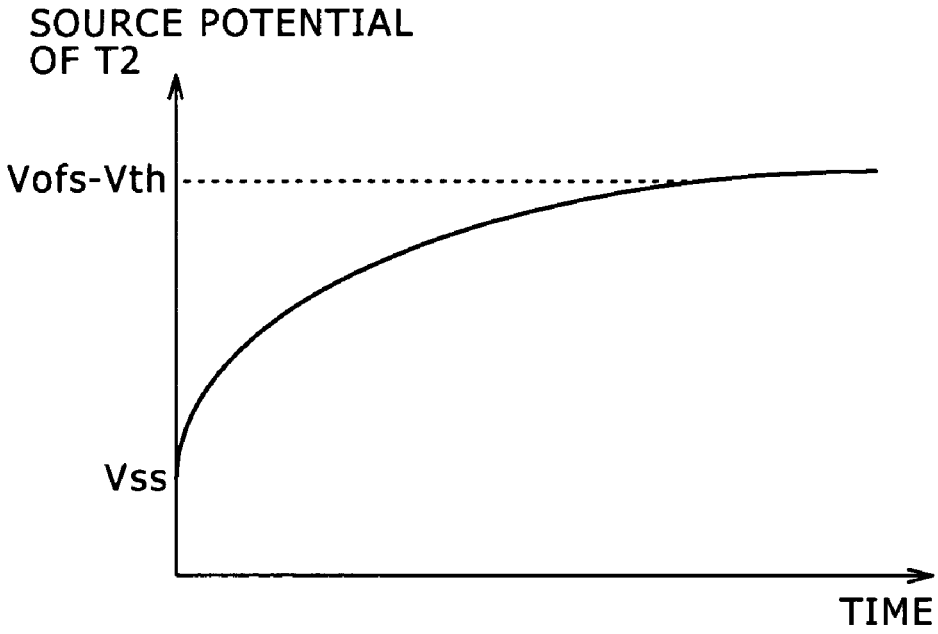
FIG. 9 is a graph for explaining the operation of the pixel shown in FIG. 2.

FIG. 9 shows temporal change in the source potential of the drive transistor T2 in the threshold voltage correction period (5) shown in FIG. 8. As shown in the diagram, the source potential of the drive transistor T2 (i.e. the anode voltage of the light-emitting element EL) increases from Vss with time elapse. After the elapse of the threshold voltage correction period (5), the drive transistor T2 is cut off and the voltage Vgs between the source S and the gate G of the drive transistor T2 becomes Vth. The source potential at this time is Vofs−Vth. If this value Vofs−Vth is still lower than Vcat+Vthel, the light-emitting element EL is in the cut-off state.

Figure 10:
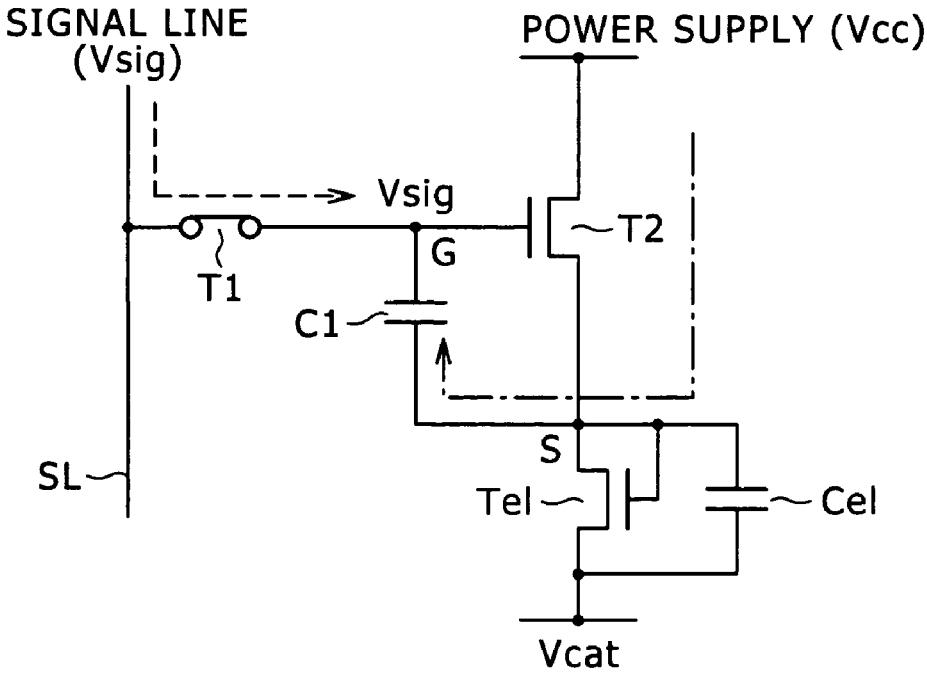
FIG. 10 is a schematic diagram for explaining the operation of the pixel shown in FIG. 2.

Referring next to FIG. 10, at the start of the writing period/mobility correction period (6), the sampling transistor T1 is turned on again in the state in which the potential of the signal line SL has been switched from Vofs to Vsig. The signal potential Vsig corresponds to the grayscale. The gate potential of the drive transistor T2 becomes Vsig because the sampling transistor T1 is turned on. On the other hand, the source potential increases with time elapse because a current flows from the power supply Vcc. Also at this time, the current flowing from the drive transistor T2 is used exclusively for charge of the equivalent capacitor Cel and the hold capacitor C1 if the source potential of the drive transistor T2 does not surpass the sum of the threshold voltage Vthel and the cathode voltage Vcat of the light-emitting element EL. At this time, the current flowing from the drive transistor T2 reflects the mobility μ because the threshold voltage correction operation for the drive transistor T2 has been already completed. Specifically, if the drive transistor T2 has higher mobility μ, the current amount at this time is larger and the increase amount ΔV of the source potential is also larger. In contrast, if the mobility μ is lower, the current amount of the drive transistor T2 is smaller and thus the increase amount ΔV of the source potential is smaller. Due to this operation, the gate voltage Vgs of the drive transistor T2 is so decreased as to reflect the mobility μ, i.e. decreased by ΔV. Thus, Vgs resulting from the complete correction of the mobility p is obtained at the timing of the completion of the mobility correction period (6).

Figure 11:
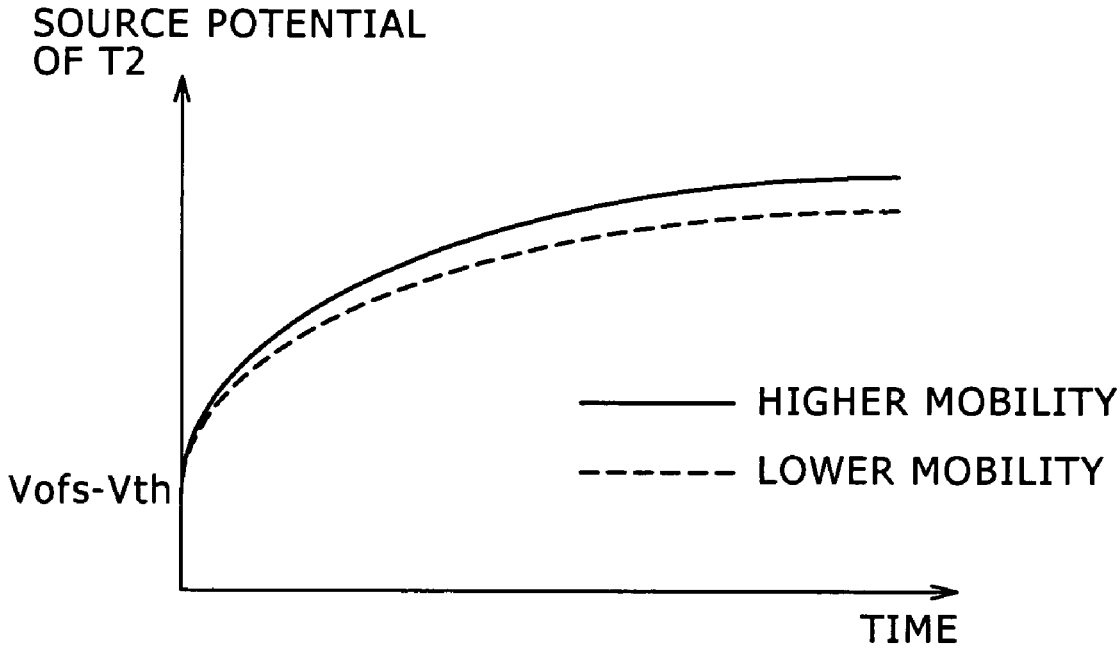
FIG. 11 is a graph for explaining the operation of the pixel shown in FIG. 2.

FIG. 11 is a graph showing temporal changes in the source potential of the drive transistor T2 in the above-described mobility correction period (6). As shown in the diagram, if the mobility of the drive transistor T2 is higher, the source potential increases faster and Vgs is correspondingly decreased. Specifically, if the mobility μ is higher, Vgs is so decreased as to cancel the influence of the higher mobility, and thus the drive current can be suppressed. On the other hand, if the mobility μ is lower, the source voltage of the drive transistor T2 does not increase so fast and therefore Vgs is also not affected strongly. Therefore, if the mobility μ is lower, Vgs of the drive transistor is not greatly decreased so that the low drive capability may be covered.

Figure 12:
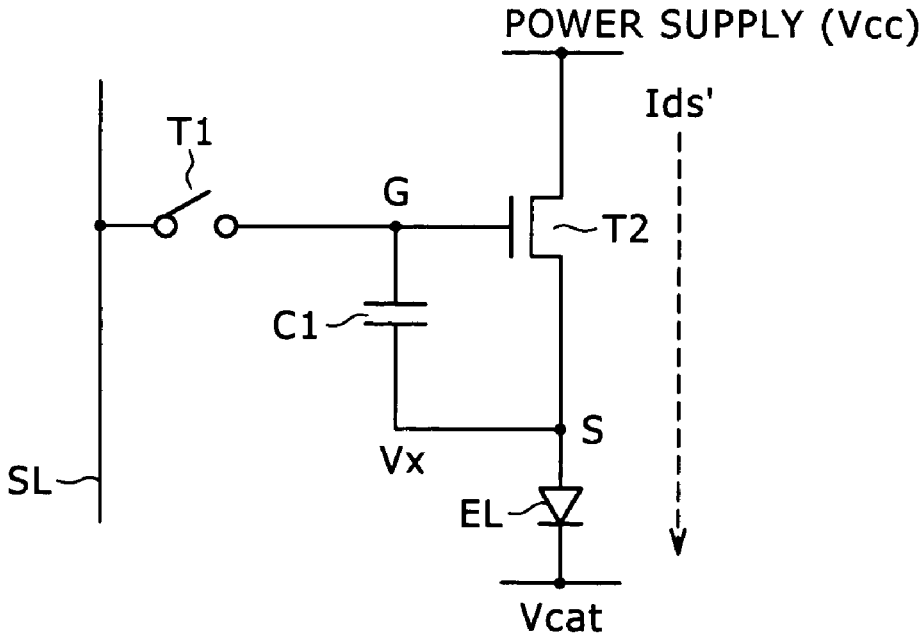
FIG. 12 is a schematic diagram for explaining the operation of the pixel shown in FIG. 2.

FIG. 12 shows the operating state in the light-emission period (7). In this light-emission period (7), the sampling transistor T1 is turned off to cause the light-emitting element EL to emit light. The gate voltage Vgs of the drive transistor T2 is kept constant, and the drive transistor T2 applies a constant current Ids' to the light-emitting element EL in accordance with the above-described characteristic equation. The anode voltage of the light-emitting element EL (i.e. the source potential of the drive transistor T2) increases to Vx because the current Ids' flows to the light-emitting element EL, and the light-emitting element EL starts to emit light at the timing when the anode voltage surpasses Vcat+Vthel. The current-voltage characteristic of the light-emitting element EL changes as the total light-emission time thereof becomes longer. Thus, the potential of the source S shown in FIG. 11 changes. However, the current Ids' flowing to the light-emitting element EL does not change because the gate voltage Vgs of the drive transistor T2 is kept at a constant value due to bootstrap operation. Therefore, even when the current-voltage characteristic of the light-emitting element EL deteriorates, the constant drive current Ids' typically flows continuously and hence the luminance of the light-emitting element EL does not change.

In the operation sequence of the pixel circuit shown in FIG. 4, adaptive control of the mobility correction time (signal writing time) is carried out. Specifically, the adaptive control of the signal writing period (i.e. the mobility correction period) is carried out by giving a slope to the falling edge of the control signal pulse applied to the gate of the sampling transistor T1. The adaptive control refers to a system of automatically carrying out variable adjustment so that the mobility correction period may be optimized depending on the signal potential. The signal potential of the video signal changes in the range from the black level to the white level depending on the grayscale. The optimum mobility correction time is not necessarily constant but depends on the grayscale level of the video signal. As a general tendency, the optimum mobility correction period is short when the luminance is at the white level, and the optimum mobility correction period is long when the luminance is at the black level.

Figure 13:
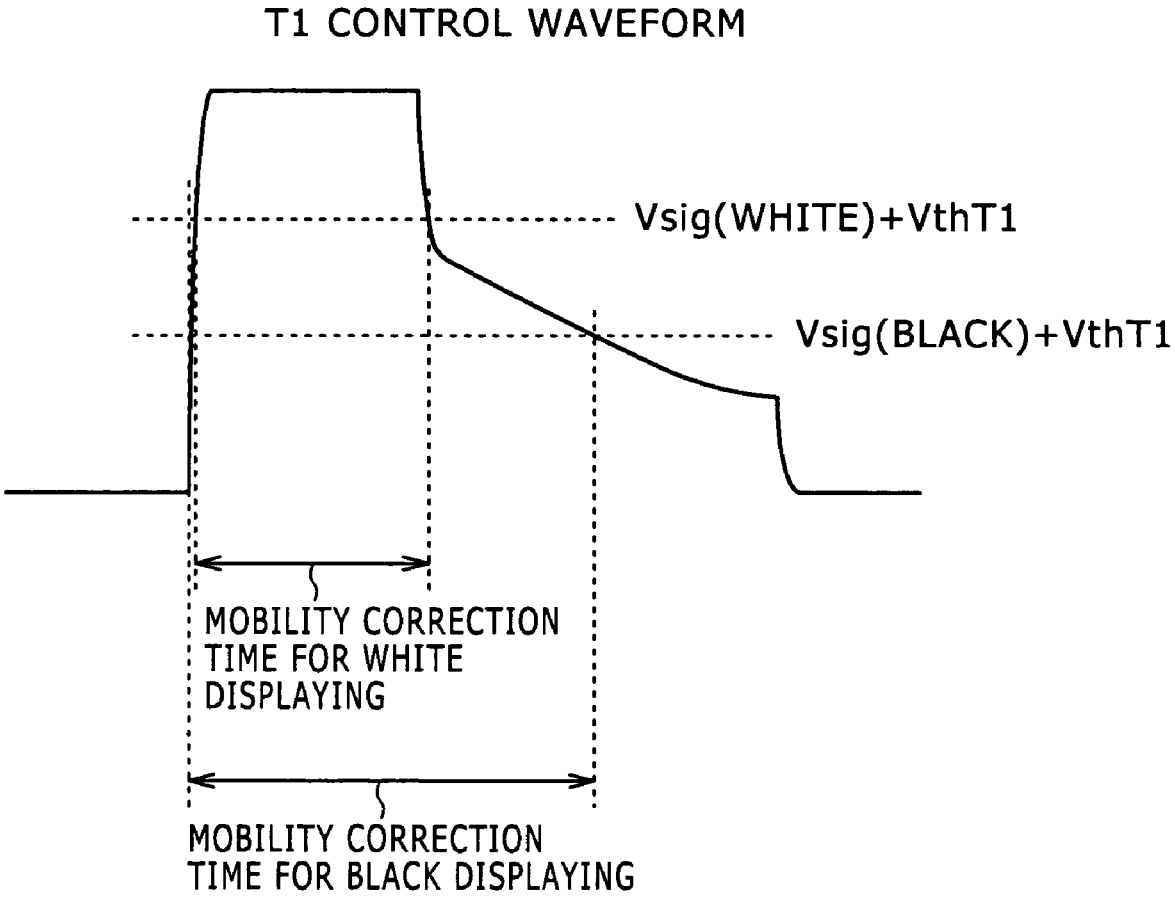
FIG. 13 is a waveform diagram for explaining the operation of the pixel shown in FIG. 2.

With reference to FIG. 13, the adaptive control of the above-described mobility correction period will be specifically described below. The control signal pulse supplied to the scan line WS has a characteristic falling-edge waveform.

Specifically, the pulse sharply drops at the beginning and then gradually changes. At the last, the pulse sharply falls down again. The pulse having this falling-edge waveform is applied to the control terminal (gate) of the sampling transistor T1. On the other hand, the signal potential Vsig is applied to the source of the sampling transistor T1. Therefore, the gate-source voltage of the sampling transistor T1 for control of the turning-on/off of the sampling transistor T1 depends on the signal potential Vsig applied to the source.

If the signal potential for white displaying is defined as Vsig(white) and the threshold voltage of the sampling transistor T1 is defined as VthT1, the sampling transistor T1 is turned off at the timing of the intersecting of the falling edge of the control signal pulse with the level of Vsig(white)+VthT1, indicated by a chain line. This turning-off timing is the timing at which the control signal pulse has just started to sharply fall down. Therefore, the signal writing period for white displaying, from the turning-on of the sampling transistor T1 to the turning-off thereof, is short. Thus, the mobility correction period for white displaying is also short.

On the other hand, if the signal potential for black displaying is defined as Vsig(black), the sampling transistor T1 is turned off when the falling edge part of the control signal pulse has become lower than Vsig(black)+VthT1, indicated by a dotted line, as shown in the diagram. Thus, the signal writing period for black displaying is long. In this manner, the adaptive control of the mobility correction period dependent on the signal potential is carried out. By giving a slope to the falling edge of the control pulse applied to the gate of the sampling transistor T1 in this manner, appropriate mobility correction can be given for all of the grayscales, and uniform image quality free from streaks and unevenness can be achieved. In particular, in the embodiment of the present invention, the sandwich gate structure is employed for the sampling transistor T1 to thereby suppress variation in the threshold voltage VthT1 of the sampling transistor T1. Therefore, the above-described adaptive control of the mobility correction time can be stably carried out. In the case of the sampling transistor T1 that does not have the sandwich gate structure, the threshold voltage VthT1 thereof changes over time and therefore the mobility correction time also changes. Thus, the optimum adaptive control may not be stably carried out.

Figure 14:
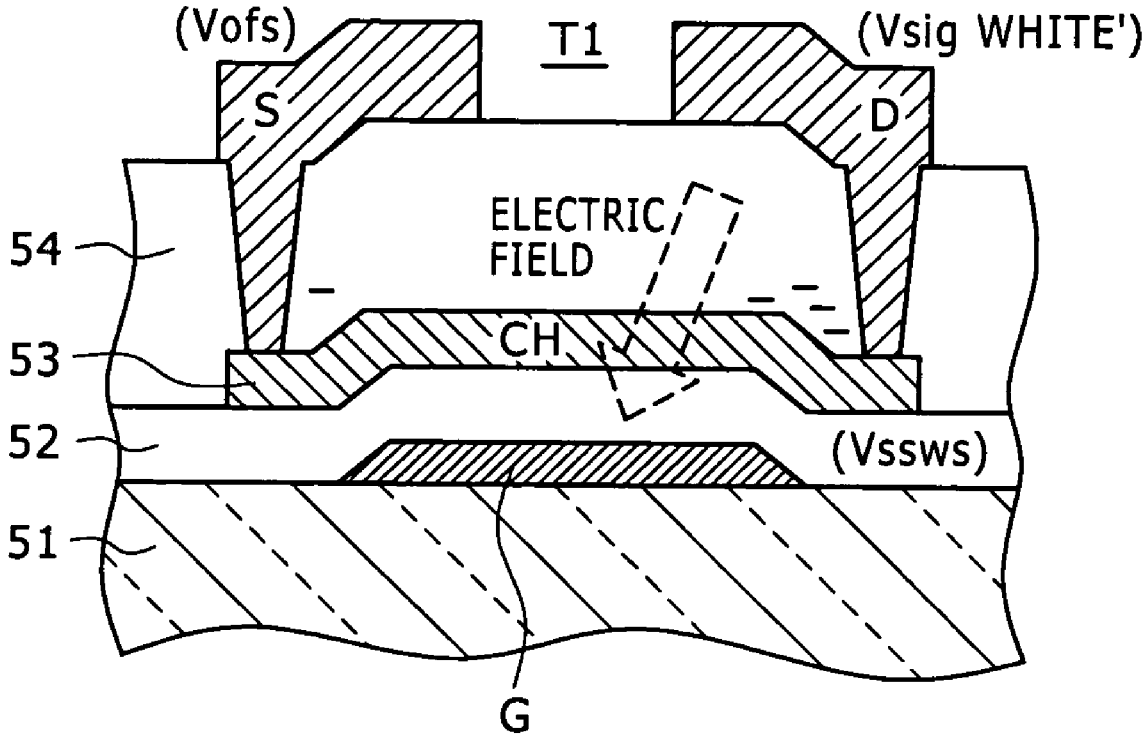
FIG. 14 is a schematic sectional view showing a reference example of the sampling transistor.

FIG. 14 is a schematic sectional view showing a reference example of the sampling transistor T1. This sampling transistor T1 has a normal bottom gate structure differently from the sandwich gate structure shown in FIG. 3 according to the embodiment of the present invention. In FIG. 14, the parts corresponding to those in the sampling transistor T1 shown in FIG. 3 are given the corresponding reference numerals for easy understanding. In the sampling transistor T1 according to this reference example, the end parts of the source electrode S and the drain electrode D formed on the interlayer insulating film 54 are extended to an area above the channel region CH so as to be used as an electric shield.

A discussion will be made below about the operating point of the sampling transistor T1 at the time of the light emission of the light-emitting element EL (particularly, at the time of white displaying). As described above, after the sampling transistor T1 is turned off subsequent to the end of the signal writing, the gate potential of the drive transistor T2 rises up along with the rise of the source potential, and therefore the gate potential becomes higher than the signal potential Vsig. Furthermore, Vofs and Vsig are repeated as the signal line potential.

However, as shown in FIG. 14, a large electric field is applied between the gate and drain of the sampling transistor T1 (between the gate of the sampling transistor T1 and the gate of the drive transistor T2) at the time of white light emission. In the diagram, Vsig(white)' denotes the gate potential of the drive transistor and Vssws denotes the off-potential of the sampling transistor T1. The relationship Vssws<Vofs<Vsig(white)' is satisfied. As a result, if the occurrence of the electric field continues, electrons in the Poly-Si are trapped by the insulating film 54 on the Poly-Si and generate a reverse electric field in such a direction as to cancel the electric field. The trapped electrons exist also when the sampling transistor T1 is turned on. Thus, the threshold voltage of the sampling transistor T1 is shifted toward the negative side due to this reverse electric field. Furthermore, this change appears more significantly with time elapse.

Figure 15:
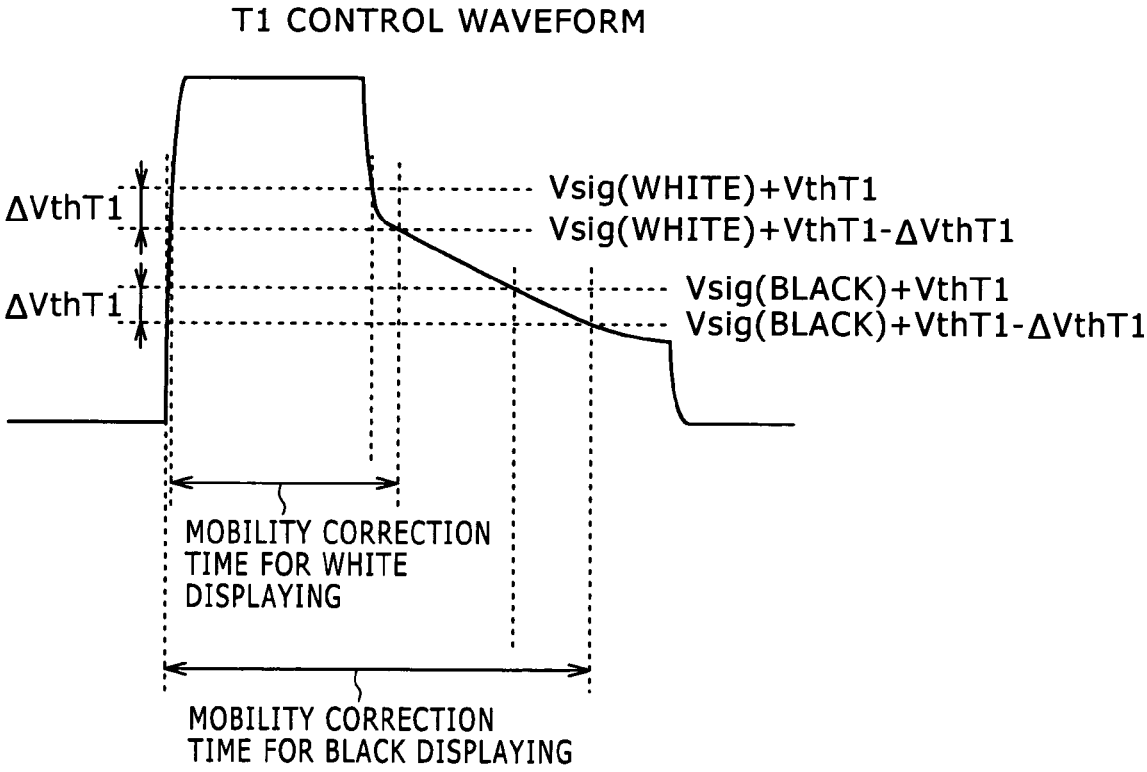
FIG. 15 is a waveform diagram for explaining the operation of the reference example.

If the threshold voltage of the sampling transistor T1 is shifted toward the negative side, the mobility correction times for white displaying and black displaying are extended corresponding to the shift of the threshold voltage as shown in FIG. 15. This effect significantly appears particularly on the falling edge side, where the control waveform of the sampling transistor T1 is distorted. As described above, at the time of white displaying, the mobility correction time itself is short and the current supplied from the power supply is large. Therefore, if the mobility correction time is extended even slightly, the source potential of the drive transistor T2 greatly rises up and the current flowing to the light-emitting element EL becomes smaller. Accordingly, the light-emission luminance decreases with time elapse and image quality defects such as streaks and unevenness occur. The falling edge of the control pulse of the sampling transistor T1 is distorted as shown in FIG. 15. Thus, even a slight amount of change in the threshold voltage leads to a large amount of change in the turning-off timing, resulting in a large amount of change in the correction time.

Figure 16:
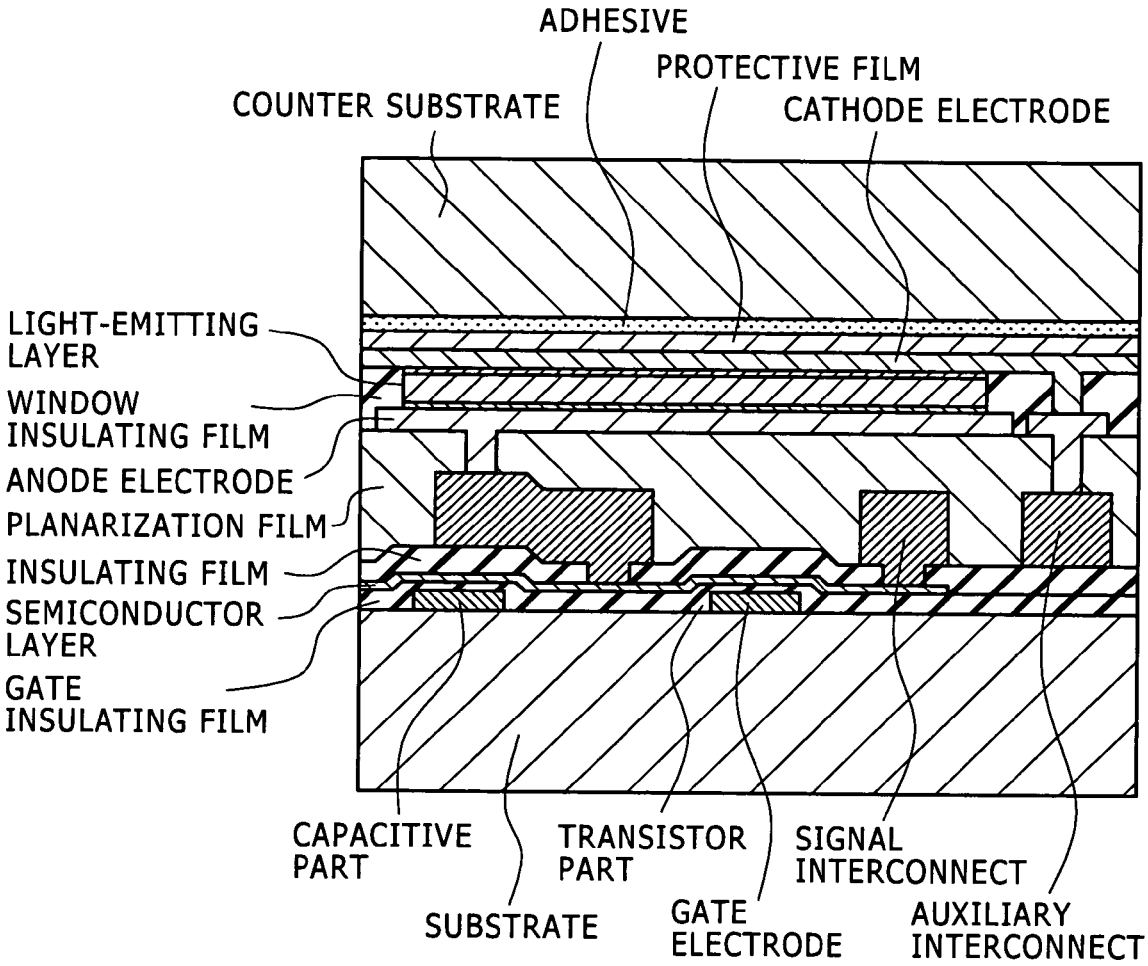
FIG. 16 is a sectional view showing the device structure of the display device according to the embodiment of the present invention.

The display device according to the embodiment of the present invention has a thin film device structure like that shown in FIG. 16. This diagram shows the schematic sectional structure of a pixel formed over an insulating substrate. As shown in the diagram, the pixel includes a transistor part having plural thin film transistors (only one TFT is shown in the diagram), a capacitive part such as a hold capacitor, and a light-emitting part such as an organic EL element. The transistor part and the capacitive part are formed on the substrate by a TFT process, and the light-emitting part such as an organic EL element is stacked thereon. A transparent counter substrate is attached over the light-emitting part with the intermediary of an adhesive, so that a flat panel is obtained.

Figure 17:
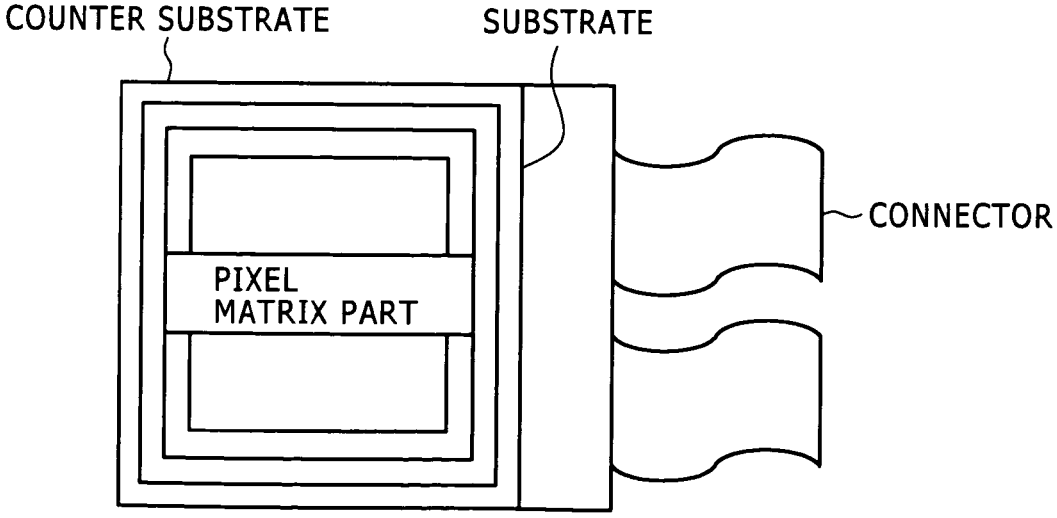
FIG. 17 is a plan view showing the module structure of the display device according to the embodiment of the present invention.

The display device according to the embodiment of the present invention encompasses a display module having a flat module shape like that shown in FIG. 17. For example, this display module is obtained as follows. A pixel array part in which pixels each including an organic EL element, thin film transistors, a thin film capacitor, and so on are integrally formed into a matrix is provided on an insulating substrate. Furthermore, an adhesive is so disposed as to surround this pixel array part (pixel matrix part), and a counter substrate composed of glass or the like is bonded to the substrate. This transparent counter substrate may be provided with e.g. a color filter, a protective film, and a light-blocking film according to need. The display module may be provided with e.g. a flexible printed circuit (FPC) as a connector for input/output of signals and so forth to/from the pixel array part from/to the external.

The display device according to the above-described embodiment of the present invention can be applied to a display (display part) that has a flat panel shape and is included in any of various kinds of electronic apparatus, such as a digital camera, a notebook personal computer, a cellular phone, and a video camcorder. Specifically, the display device can be applied to a display (display part) in electronic apparatus in any field, capable of displaying information input to the main body part of the electronic apparatus or produced in the main body part of the electronic apparatus as an image or video. Examples of electronic apparatus to which such a display device is applied will be described below.

Figure 18:
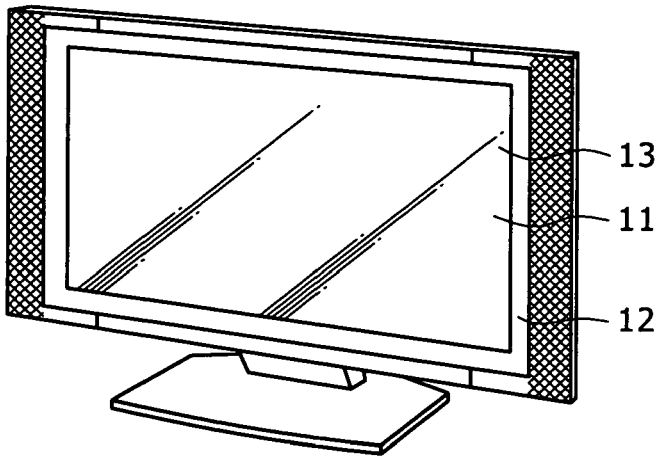
FIG. 18 is a perspective view showing a television set including the display device according to the embodiment of the present invention.

FIG. 18 shows a television to which the embodiment of the present invention is applied. This television includes a video display screen 11 composed of a front panel 12, a filter glass 13, and so on, and is fabricated by using the display device according to the embodiment of the present invention as the video display screen 11.

Figure 19:
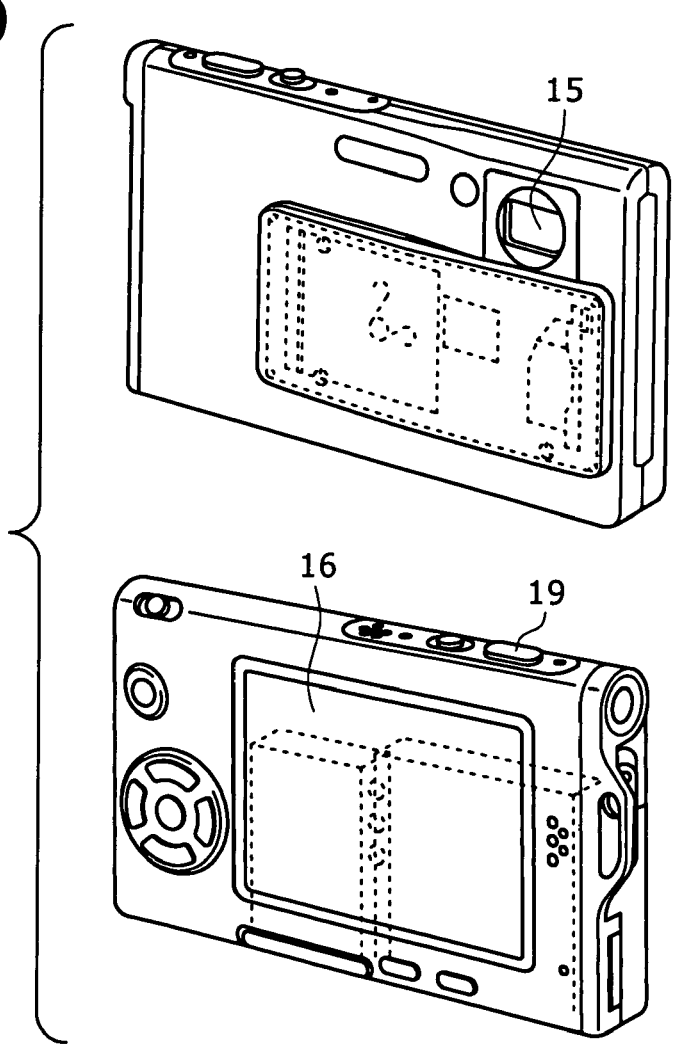
FIG. 19 is a perspective view showing a digital still camera including the display device according to the embodiment of the present invention.

FIG. 19 shows a digital camera to which the embodiment of the present invention is applied: the upper diagram is a front view and the lower diagram is a rear view. This digital camera includes an imaging lens, a light emitter 15 for flash, a display part 16, a control switch, a menu switch, a shutter button 19, and so on, and is fabricated by using the display device according to the embodiment of the present invention as the display part 16.

Figure 20:
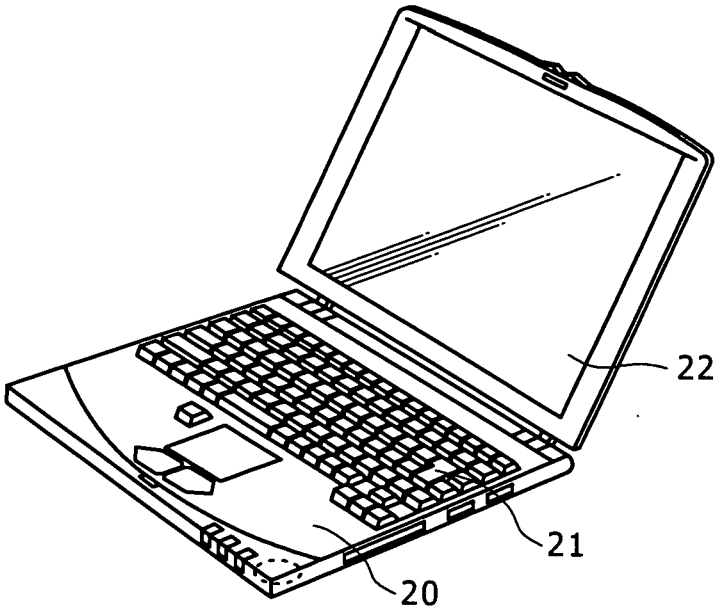
FIG. 20 is a perspective view showing a notebook personal computer including the display device according to the embodiment of the present invention.

FIG. 20 shows a notebook personal computer to which the embodiment of the present invention is applied. A main body 20 thereof includes a keyboard 21 that is operated in input of characters and so on, and the body cover thereof includes a display part 22 for image displaying. This notebook personal computer is fabricated by using the display device according to the embodiment of the present invention as the display part 22.

Figure 21:
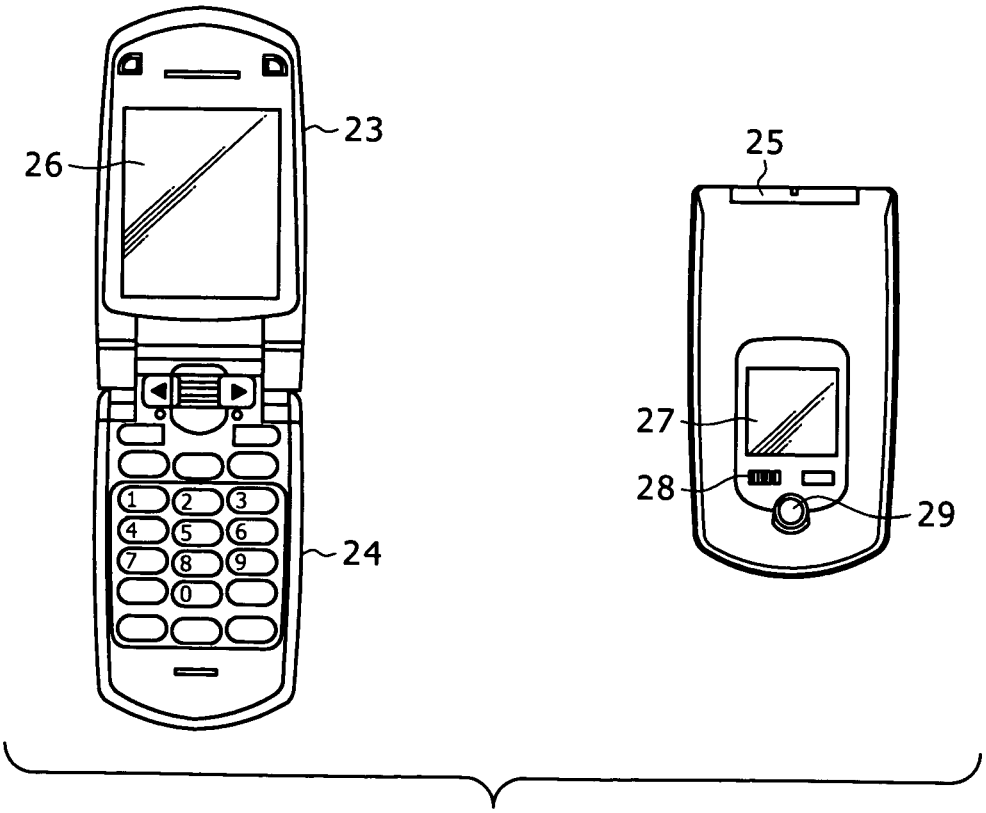
FIG. 21 is a schematic diagram showing portable terminal apparatus including the display device according to the embodiment of the present invention.

FIG. 21 shows portable terminal apparatus to which the embodiment of the present invention is applied: the left diagram shows the opened state and the right diagram shows the closed state. This portable terminal apparatus includes an upper casing 23, a lower casing 24, a connection (hinge) 25, a display 26, a sub-display 27, a picture light 28, a camera 29, and so on. This portable terminal apparatus is fabricated by using the display device according to the embodiment of the present invention as the display 26 and the sub-display 27.

Figure 22:
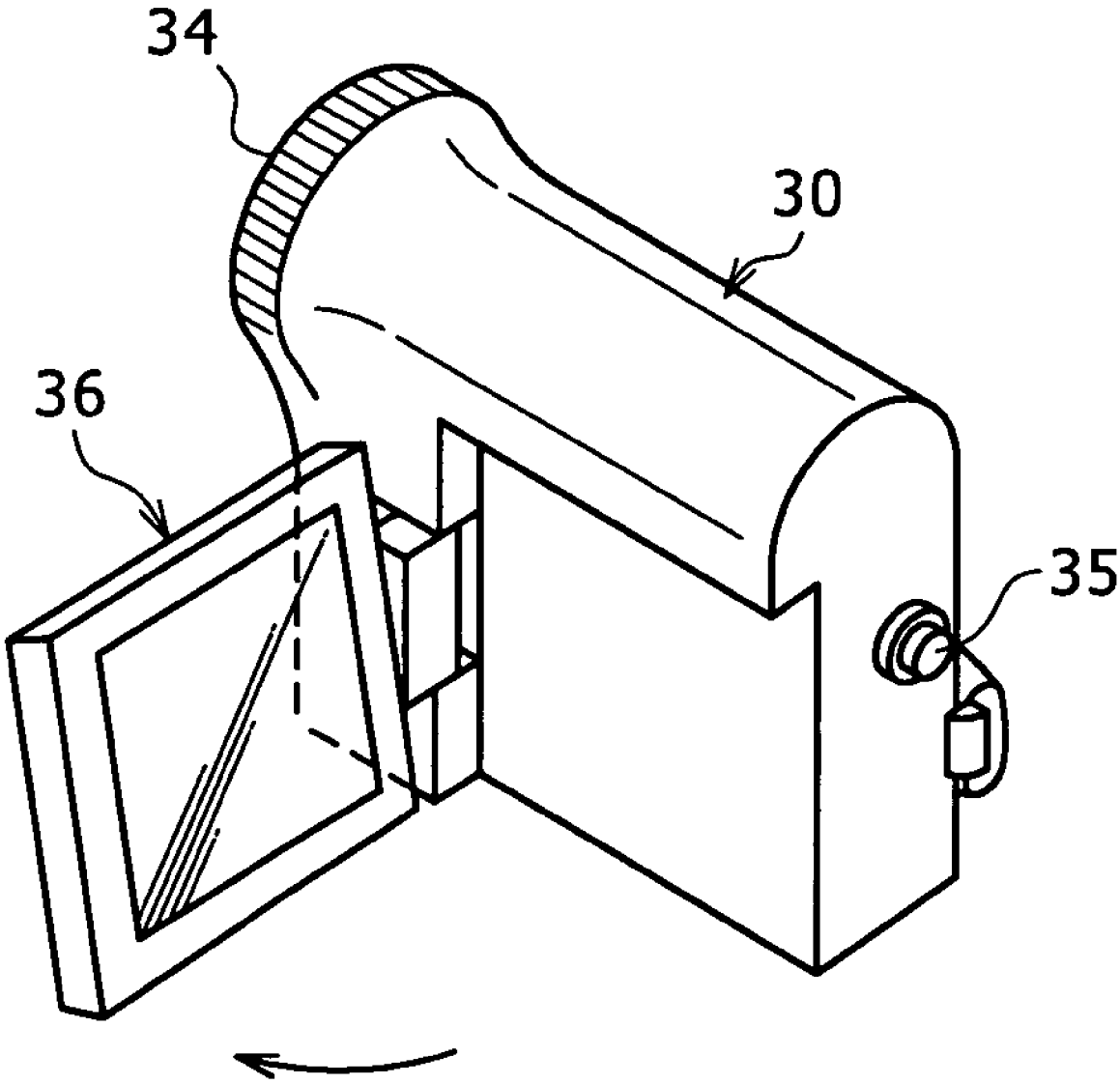
FIG. 22 is a perspective view showing a video camcorder including the display device according to the embodiment of the present invention.
Figure 23:
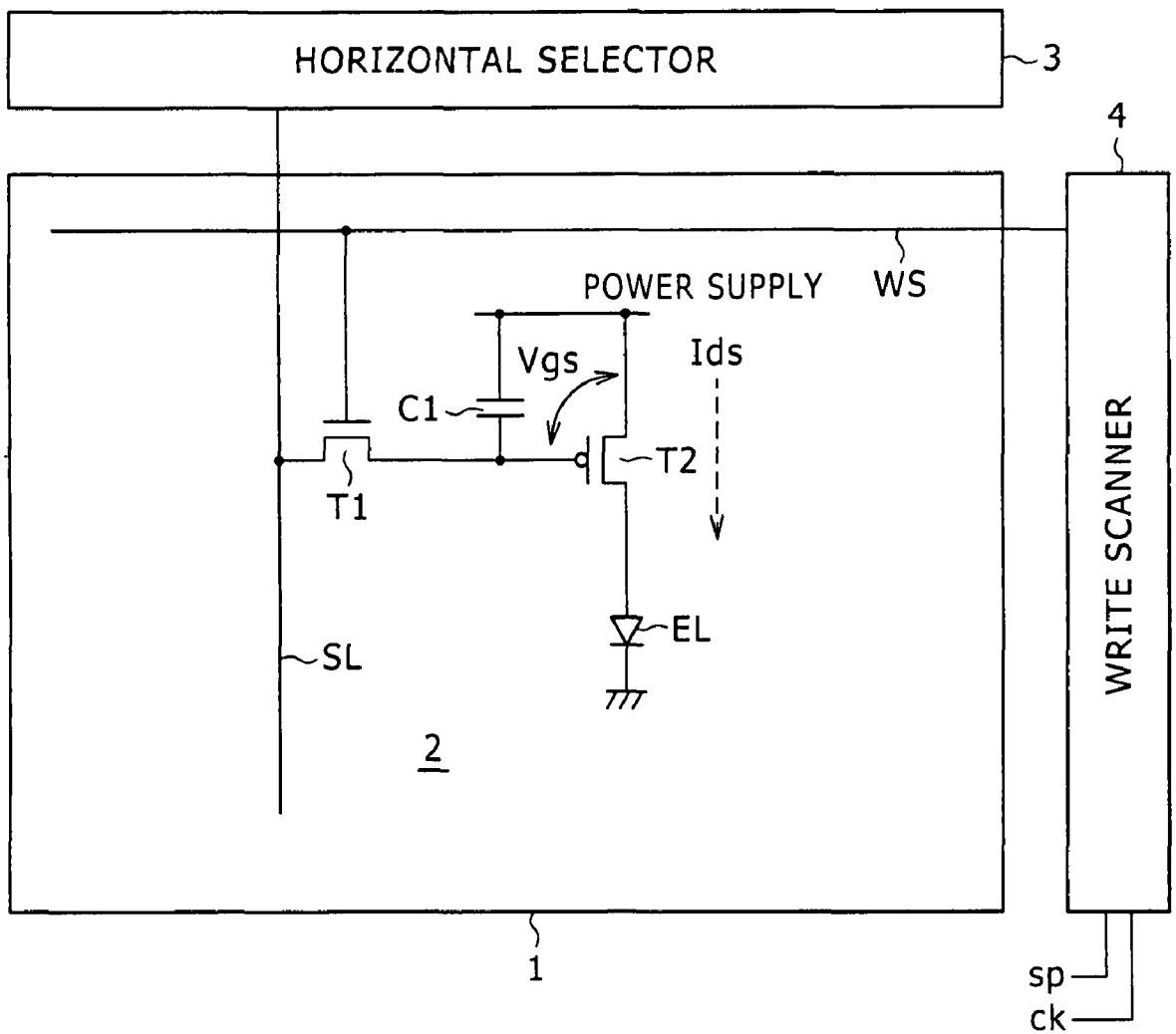
FIG. 23 RELATED ART
FIG. 23 is a circuit diagram showing one example of a related-art display device.
Figure 24:
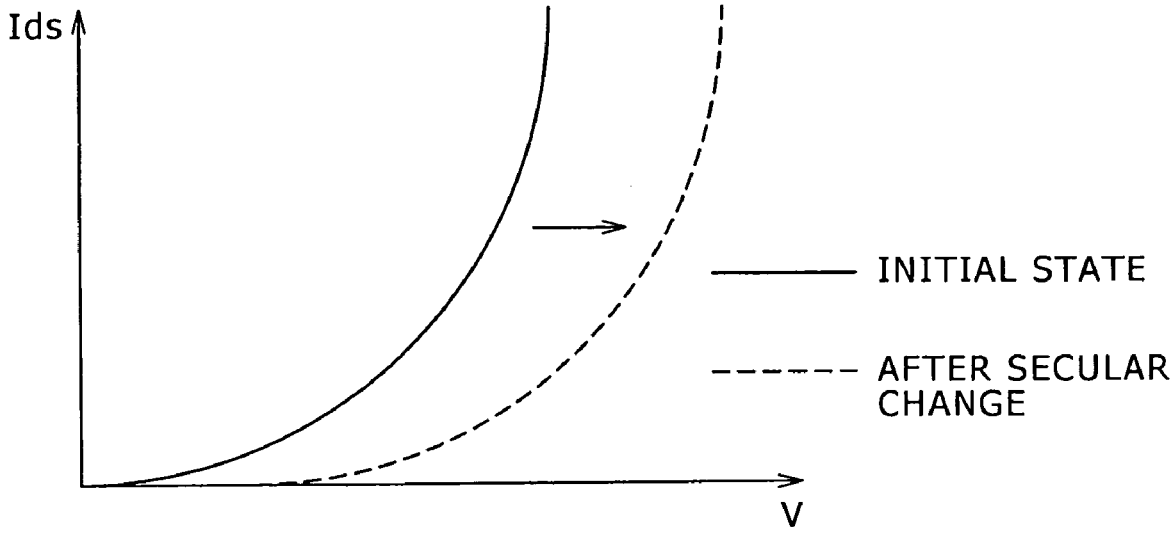
FIG. 24 is a graph showing the current-voltage characteristic of a light-emitting element.
Figure 25:
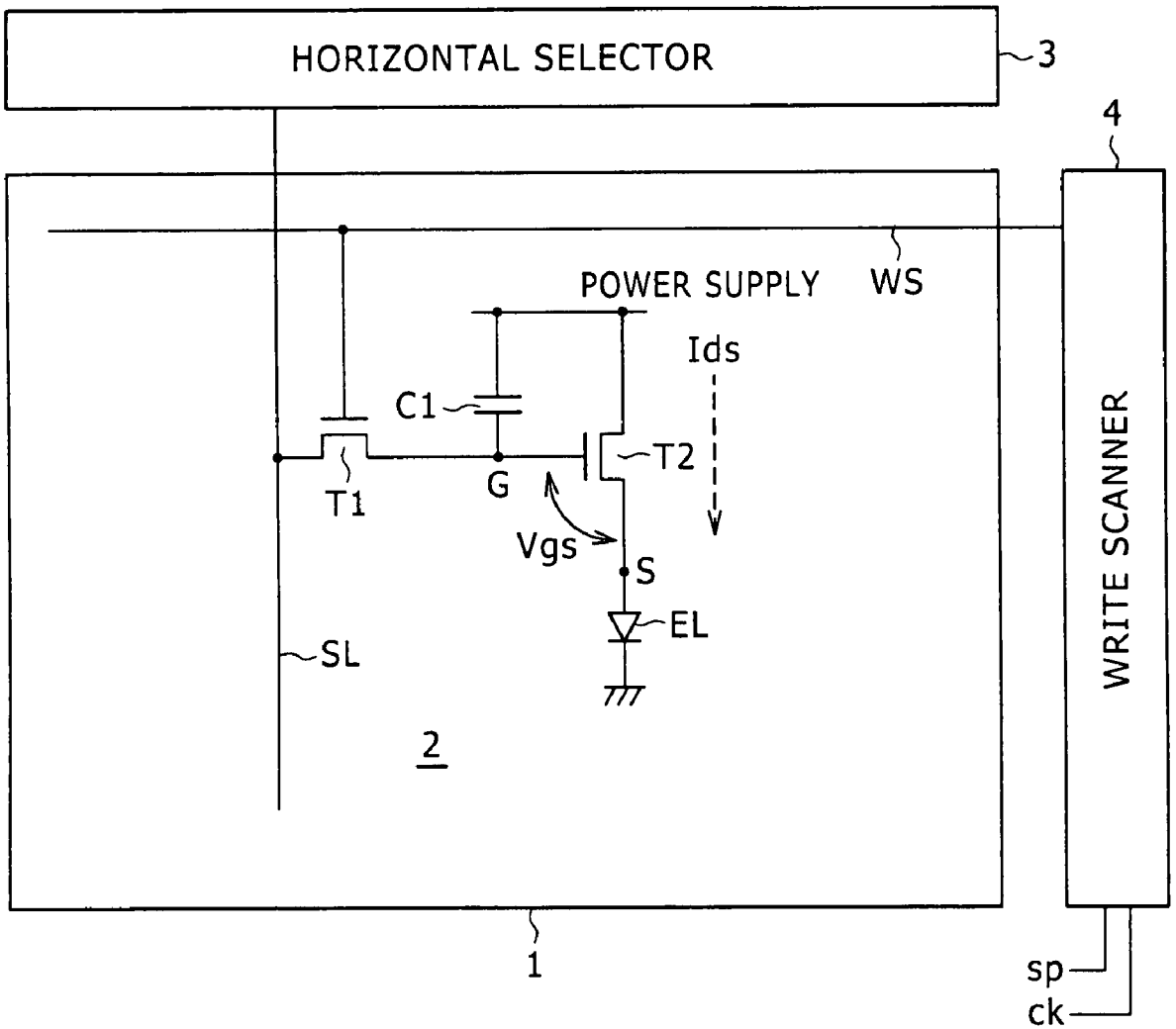
FIG. 25 is a circuit diagram showing another example of the related-art display device.

FIG. 22 shows a video camcorder to which the embodiment of the present invention is applied. This video camcorder includes a main body part 30, a lens 34 that is disposed on the front side of the video camcorder and used for subject photographing, a start/stop switch 35 for photographing, a monitor 36, and so on. This video camcorder is fabricated by using the display device according to the embodiment of the present invention as the monitor 36.

The present application contains subject matter related to that disclosed in Japanese Priority Patent Application JP 2008-200838 filed in the Japan Patent Office on Aug. 4, 2008, the entire content of which is hereby incorporated by reference.

It should be understood by those skilled in the art that various modifications, combinations, sub-combinations and alterations may occur depending on design requirements and other factor in so far as they are within the scope of the appended claims or the equivalents thereof.

What is claimed is:

1. A display device comprising:

a pixel array part configured to include scan lines disposed along rows, signal lines disposed along columns, and pixels that are disposed at intersections of the scan lines and the signal lines and are arranged in a matrix; and a drive part configured to drive the pixel array part and include a control scanner and a signal selector, the control scanner sequentially applying a control pulse to the scan lines with a horizontal cycle to thereby line-sequentially scan the pixels on a row-by-row basis, the signal selector supplying a video signal to the signal lines disposed along the columns in matching with the line-sequential scanning, wherein the pixel includes a sampling transistor having a gate connected to the scan line and a source and a drain one of which is connected to the signal line, a drive transistor having a gate connected to the other of the source and the drain of the sampling transistor and a source and a drain one of which is connected to a power supply, a light-emitting element connected to the other of the source and the drain of the drive transistor, and a hold capacitor connected between the source and the gate of the drive transistor, the sampling transistor is kept at an on-state during a period from rising of a control pulse supplied from the control scanner to the scan line to falling of the control pulse with a time width shorter than one horizontal cycle, and samples a video signal from the signal line to write the video signal to the hold capacitor, the sampling transistor includes a channel region between the source and the drain and has a sandwich gate structure in which the gate exists on one surface side of the channel region with intermediary of an insulating film and a shield that electrically shields the channel region is disposed on the other surface side of the channel region, and the drive transistor causes a drive current dependent on a video signal written to the hold capacitor to flow to the light-emitting element for light emission.

2. The display device according to claim 1, wherein the shield is connected to the same potential as potential of the gate.

3. The display device according to claim 1, wherein the drive transistor has a shield structure different from a shield structure of the sampling transistor.

4. An electronic apparatus including a main body part and a display part that displays information output from the main body part, the display part comprising:

a pixel array part configured to include scan lines disposed along rows, signal lines disposed along columns, and pixels that are disposed at intersections of the scan lines and the signal lines and are arranged in a matrix; and a drive part configured to drive the pixel array part and include a control scanner and a signal selector, the control scanner sequentially applying a control pulse to the scan lines with a horizontal cycle to thereby line-sequentially scan the pixels on a row-by-row basis, the signal selector supplying a video signal to the signal lines disposed along the columns in matching with the line-sequential scanning, wherein the pixel includes a sampling transistor having a gate connected to the scan line and a source and a drain one of which is connected to the signal line, a drive transistor having a gate connected to the other of the source and the drain of the sampling transistor and a source and a drain one of which is connected to a power supply, a light-emitting element connected to the other of the source and the drain of the drive transistor, and a hold capacitor connected between the source and the gate of the drive transistor, the sampling transistor is kept at an on-state during a period from rising of a control pulse supplied from the control scanner to the scan line to falling of the control pulse with a time width shorter than one horizontal cycle, and samples a video signal from the signal line to write the video signal to the hold capacitor, the sampling transistor includes a channel region between the source and the drain and has a sandwich gate structure in which the gate exists on one surface side of the channel region with intermediary of an insulating film and a shield that electrically shields the channel region is disposed on the other surface side of the channel region, and the drive transistor causes a drive current dependent on a video signal written to the hold capacitor to flow to the light-emitting element for light emission.

5. A display device comprising:

pixel array means for including scan lines disposed along rows, signal lines disposed along columns, and pixels that are disposed at intersections of the scan lines and the signal lines and are arranged in a matrix; and drive means for driving the pixel array means and including a control scanner and a signal selector, the control scanner sequentially applying a control pulse to the scan lines with a horizontal cycle to thereby line-sequentially scan the pixels on a row-by-row basis, the signal selector supplying a video signal to the signal lines disposed along the columns in matching with the line-sequential scanning, wherein the pixel includes a sampling transistor having a gate connected to the scan line and a source and a drain one of which is connected to the signal line, a drive transistor having a gate connected to the other of the source and the drain of the sampling transistor and a source and a drain one of which is connected to a power supply, a light-emitting element connected to the other of the source and the drain of the drive transistor, and a hold capacitor connected between the source and the gate of the drive transistor, the sampling transistor is kept at an on-state during a period from rising of a control pulse supplied from the control scanner to the scan line to falling of the control pulse with a time width shorter than one horizontal cycle, and samples a video signal from the signal line to write the video signal to the hold capacitor, the sampling transistor includes a channel region between the source and the drain and has a sandwich gate structure in which the gate exists on one surface side of the channel region with intermediary of an insulating film and a shield that electrically shields the channel region is disposed on the other surface side of the channel region, and the drive transistor causes a drive current dependent on a video signal written to the hold capacitor to flow to the light-emitting element for light emission.

6. An electronic apparatus including a main body part and a display part that displays information output from the main body part, the display part comprising:

pixel array means for including scan lines disposed along rows, signal lines disposed along columns, and pixels that are disposed at intersections of the scan lines and the signal lines and are arranged in a matrix; and drive means for driving the pixel array means and including a control scanner and a signal selector, the control scanner sequentially applying a control pulse to the scan lines with a horizontal cycle to thereby line-sequentially scan the pixels on a row-by-row basis, the signal selector supplying a video signal to the signal lines disposed along the columns in matching with the line-sequential scanning, wherein the pixel includes a sampling transistor having a gate connected to the scan line and a source and a drain one of which is connected to the signal line, a drive transistor having a gate connected to the other of the source and the drain of the sampling transistor and a source and a drain one of which is connected to a power supply, a light-emitting element connected to the other of the source and the drain of the drive transistor, and a hold capacitor connected between the source and the gate of the drive transistor, the sampling transistor is kept at an on-state during a period from rising of a control pulse supplied from the control scanner to the scan line to falling of the control pulse with a time width shorter than one horizontal cycle, and samples a video signal from the signal line to write the video signal to the hold capacitor, the sampling transistor includes a channel region between the source and the drain and has a sandwich gate structure in which the gate exists on one surface side of the channel region with intermediary of an insulating film and a shield that electrically shields the channel region is disposed on the other surface side of the channel region, and the drive transistor causes a drive current dependent on a video signal written to the hold capacitor to flow to the light-emitting element for light emission.

* * * * *